US007063277B2

(12) United States Patent
Englhard et al.

(10) Patent No.: US 7,063,277 B2
(45) Date of Patent: Jun. 20, 2006

(54) SINGLE LONGITUDINAL VALVE READY TO USE HOSE END SPRAYER

(75) Inventors: Ronald F. Englhard, Dove Canyon, CA (US); Donald J. Shanklin, Corona, CA (US)

(73) Assignee: Hayes Products, LLC., Buena Park, CA (US)

( * ) Notice: Subject to any disclaimer, the term of this patent is extended or adjusted under 35 U.S.C. 154(b) by 0 days.

(21) Appl. No.: 10/630,230

(22) Filed: Jul. 30, 2003

(65) Prior Publication Data

US 2004/0140372 A1 Jul. 22, 2004

Related U.S. Application Data

(60) Provisional application No. 60/457,822, filed on Mar. 25, 2003, provisional application No. 60/400,214, filed on Jul. 31, 2002.

(51) Int. Cl.
*B05B 7/30* (2006.01)
*F23D 14/60* (2006.01)
*F23D 11/46* (2006.01)

(52) U.S. Cl. ..... 239/318; 239/353; 239/354; 239/414

(58) Field of Classification Search ..... 239/318, 239/353, 354, 414, 302, 310, 316, 407, 413, 239/418, 426, 433, 434, 537, 538, 579, 581.1, 239/340, 344, 525; 222/630, 637
See application file for complete search history.

(56) References Cited

U.S. PATENT DOCUMENTS 2,571,871 A 10/1951 Hayes
3,134,545 A 5/1964 Armond
3,186,643 A 6/1965 George et al.
3,207,443 A 9/1965 Gilmour
3,291,395 A * 12/1966 Sharp ..... 239/318
3,770,205 A 11/1973 Proctor et al.
3,940,069 A 2/1976 Gunzel, Jr. et al.
RE29,405 E 9/1977 Gunzel, Jr. et al.
4,281,796 A 8/1981 Fugent et al.
4,349,157 A 9/1982 Beiswenger et al.
4,369,921 A 1/1983 Beiswenger et al.
4,508,272 A 4/1985 Thompson
4,595,127 A 6/1986 Stoody
4,736,891 A 4/1988 Chow et al.
4,750,674 A 6/1988 Chow et al.
4,826,085 A 5/1989 Chow et al.

(Continued)

*Primary Examiner*—Darren Gorman
(74) *Attorney, Agent, or Firm*—Knobbe, Martens, Olson & Bear, LLP

(57) ABSTRACT

A sprayer head assembly comprises a chemical passage, a carrier fluid passage, and a housing that has an outer surface and an inner surface, which defines a valve chamber configured to be in communication with the chemical and carrier fluid passages. A valve is moveably positioned within the valve chamber between at least a first position, a second position and a third position. The valve defines a first passage, a second passage and a chemical inlet passage that is in communication with the second passage. The valve is configured such that, in the first position, the valve blocks the chemical and carrier fluid passages, in the second position, the first passage is configured to be in communication with the carrier fluid passage while the valve blocks the chemical fluid passage, and in the third position, the second passage is configured to be in communication with the carrier fluid passage and the chemical inlet passage is configured to be in communication with the chemical passage.

34 Claims, 26 Drawing Sheets

U.S. PATENT DOCUMENTS

| | | | | |
|---|---|---|---|---|
| 4,901,923 | A | 2/1990 | McRoskey et al. | |
| 5,007,588 | A | 4/1991 | Chow et al. | |
| 5,039,016 | A | 8/1991 | Gunzel, Jr. et al. | |
| 5,100,059 | A | 3/1992 | Englhard et al. | |
| 5,213,264 | A | 5/1993 | Styne | |
| 5,213,265 | A | 5/1993 | Englhard et al. | |
| 5,320,288 | A | 6/1994 | Ketcham, Jr. | |
| 5,356,076 | A | 10/1994 | Bishop | |
| 5,372,310 | A | 12/1994 | Ketcham | |
| 5,383,603 | A | 1/1995 | Englhard et al. | |
| D358,865 | S | 5/1995 | Englhard et al. | |
| 5,595,345 | A | 1/1997 | Chura et al. | |
| 5,655,563 | A | 8/1997 | Johnson | |
| 5,850,973 | A | 12/1998 | Liljeqvist et al. | |
| 5,954,272 | A | 9/1999 | Liao | |
| 6,267,304 | B1 | 7/2001 | Schultz | |
| 6,378,785 | B1 | 4/2002 | Dodd | |
| 6,471,141 | B1 | 10/2002 | Smith et al. | |
| 6,578,776 | B1 * | 6/2003 | Shanklin et al. | 239/318 |
| 6,749,133 | B1 * | 6/2004 | Ketcham et al. | 239/318 |

* cited by examiner

OFF

RINSE

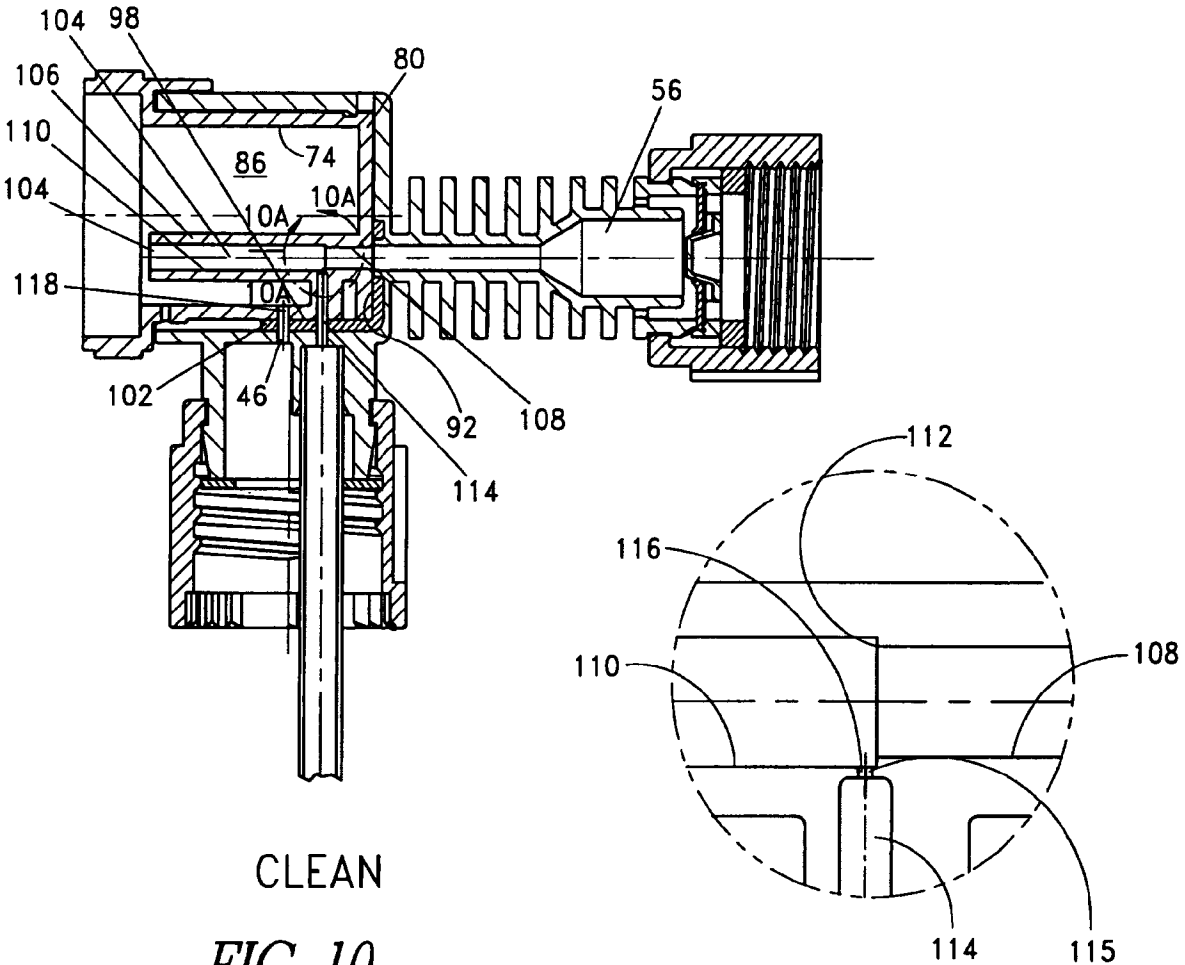
FIG. 10
FIG. 10A
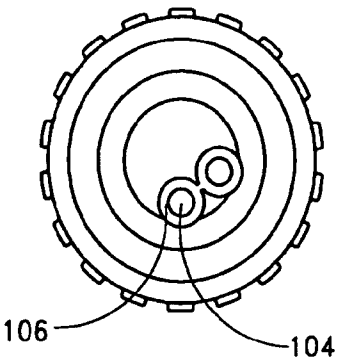
FIG. 11

OFF

RINSE

CLEAN

FIG. 25
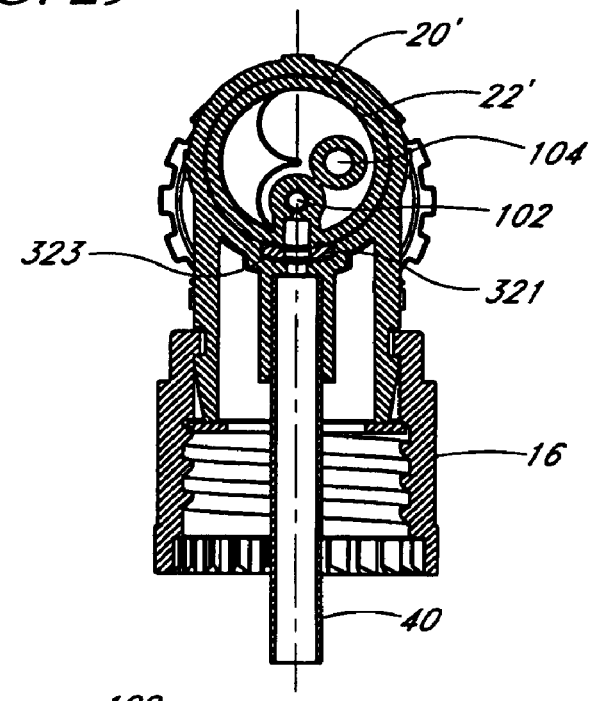
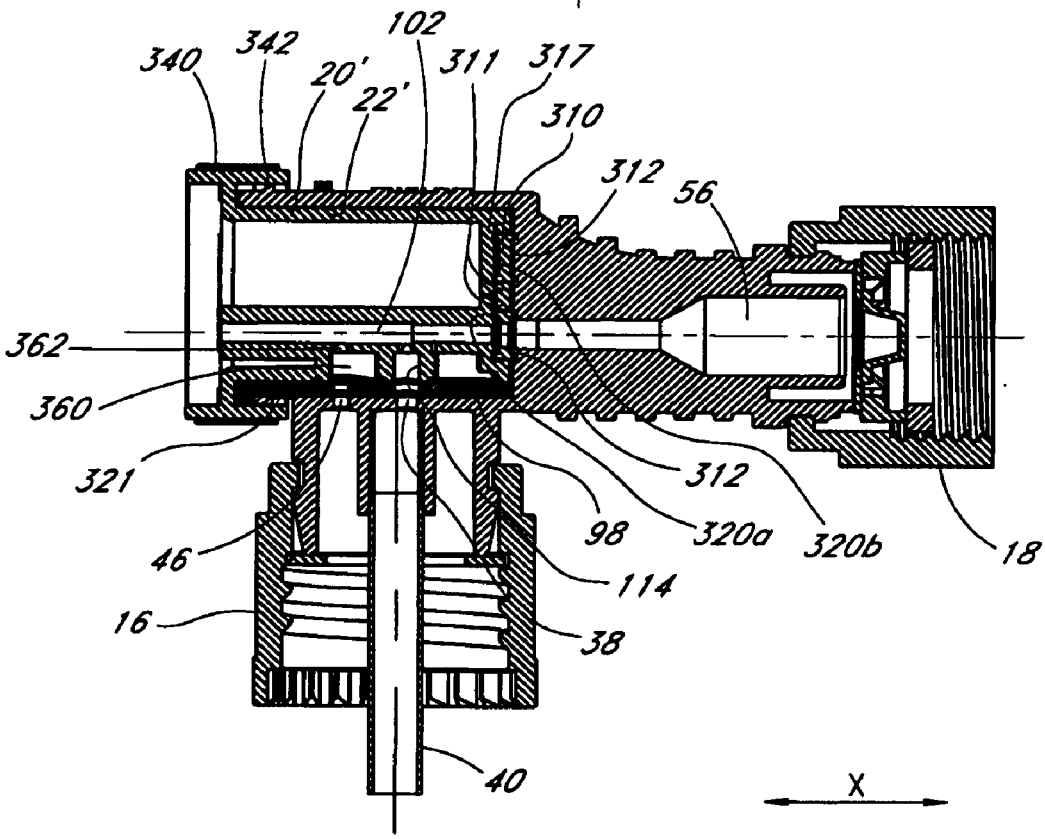
FIG. 26

SINGLE LONGITUDINAL VALVE READY TO USE HOSE END SPRAYER

PRIORITY INFORMATION

This application claims the priority benefit under 35 U.S.C. § 119(e) of Provisional Application 60/457,822 filed Mar. 25, 2003 and Provisional Application 60/400,214 filed Jul. 31, 2002, the entire contents of these applications are hereby incorporated by reference herein.

BACKGROUND OF THE INVENTION

1. Field of the Invention

The present invention relates to chemical dispensing sprayers and, in particular, to aspiration-type sprayers that use a relatively large amount of carrier fluid for dispensing a relatively small amount of a chemical solution.

2. Description of the Related Art

Every year consumers apply thousands of gallons of chemicals such as fertilizers or pesticides to plants, lawns, flowers, vegetable gardens and other organic type vegetation. Typically, such chemicals are sold in plastic containers in a concentrated form. While in this concentrated form, the chemical is extremely hazardous to the consumer end user and the environment in general. Accordingly, the container typically includes an aspiration-type sprayer head assembly. An aspiration-type sprayer uses a relatively large amount of carrier fluid, such as water, to withdraw, dilute and dispense a relatively small amount of chemical from the container. To further prevent harm to the consumer, the container and the sprayer head assembly are preferably disposed of after the container's contents are exhausted. It is therefore desirable to provide a sprayer head assembly that is sufficiently low cost so as to allow the entire unit to be discarded and yet reliable and safe.

In some applications, it is desirable to use a sprayer head assembly to selectively apply the chemical/carrier mixture and the carrier fluid to a surface. For example, the chemical/carrier mixture may form a cleaning solution, which is rinsed away by the carrier fluid. Such a sprayer head assembly is particularly useful for cleaning surfaces that cannot be physically reached by the user but can be reached by the spray generated by the sprayer head assembly. U.S. Pat. No. 5,595,345 describes one such sprayer head assembly. However, this sprayer assembly includes a relatively large number of parts and is difficult to manufacture and to assemble. U.S. Pat. No. 3,940,069 describes a sprayer head assembly that is capable of forming two different ratios of a chemical/carrier fluid mixture. However, this sprayer head assembly also includes a relatively large number of parts and is difficult to manufacture and assemble.

SUMMARY OF THE INVENTION

It is therefore an object of the invention to provide a safe and reliable aspiration type chemical sprayer that utilizes a minimum number of components and that is relatively easy to manufacture and assemble. By reducing the number of components, inventory costs can be greatly reduced. It is also desirable that most of the parts can be made form injection molded plastic, which is relatively inexpensive.

Accordingly, one embodiment of the present invention involves a sprayer head assembly for connection to a container that defines a cavity for storing a chemical to be sprayed. The sprayer head assembly comprises a chemical passage configured to be in communication with the cavity.

A carrier fluid passage is configured to be in communication with a carrier fluid source. A valve chamber is configured to be in communication with the chemical and carrier fluid passages. A valve is moveably positioned within the valve chamber and is moveable between at least a first position, a second position and a third position. The valve defines a first passage, a second passage and a chemical inlet passage that is in communication with the second passage. The valve is configured such that, in the first position, the valve blocks the chemical and carrier fluid passages, in the second position, the first passage is configured to be in communication with the carrier fluid passage while the valve blocks the chemical fluid passage, and in the third position, the second passage is configured to be in communication with the carrier fluid passage and the chemical inlet passage is configured to be in communication with the chemical passage. At least one sealing member is positioned within the at least one recess positioned within the valve chamber. The at least one sealing member defines a sealing portion which extends around a first interface between the carrier fluid passage and the valve and a second interface between the chemical passage and the valve. In another embodiment, the at least one sealing member also extends around a third interface between a vent passage and an atmospheric source.

Another embodiment of the of the present invention involves a sprayer head assembly for connection to a container that defines a cavity for storing a chemical to be sprayed. The sprayer head assembly comprises a chemical passage configured to be in communication with the cavity. The chemical passage has an outlet defining a chemical outlet axis. A carrier fluid passage is configured to be in communication with a carrier fluid source. The carrier fluid passage has an outlet defining a carrier fluid outlet axis. A valve chamber is configured to be in communication with the chemical and carrier fluid passages. A valve is moveably positioned within the valve chamber between at least a first position, a second position and a third position. The valve defines a first passage, a second passage and a chemical inlet passage that is in communication with the second passage. The valve is configured such that, in the first position, the valve blocks the chemical and carrier fluid passages, in the second position, the first passage is configured to be in communication with the carrier fluid passage while the valve blocks the chemical fluid passage, and in the third position, the second passage is configured to be in communication with the carrier fluid passage and the chemical inlet passage is configured to be in communication with the chemical passage. The valve is further configured to rotate about a first axis that is substantially parallel to the carrier fluid outlet axis e and substantially perpendicular to the chemical outlet axis.

Yet, another embodiment of the present invention involves a method for assembling a sprayer head assembly. The method comprises providing a housing defining a valve chamber that is in communication with a chemical passage and a carrier fluid passage, the valve chamber defining at least one recess. A valve is configured to fit within the valve chamber and having at least a first passage, a second passage and a chemical inlet passage that is in communication with the second passage. A sealing member is placed into the recess. The valve is inserted into the valve chamber. The valve is coupled to the housing in a snap fit.

Another embodiment of the present invention is a method for assembling a sprayer head assembly comprising providing a housing defining a valve chamber that is in communication with a chemical passage and a carrier fluid passage, the valve chamber defining at least one recess. A valve is configured to fit within the valve chamber and has at least a first passage, a second passage and a chemical inlet passage that is in communication with the second passage. A sealing member is placed into the recess. The valve is inserted into the valve chamber. The valve is coupled to the housing with a screw.

Another embodiment of the present invention is a method of operating a chemical sprayer. A valve is rotated about a longitudinal axis such that a first passage of the valve is aligned with a rinsing liquid passage of the chemical sprayer and a second passage of the valve is aligned with a chemical passage of the chemical sprayer. A mixture of the rinsing liquid and chemical is applied to a target surface. A valve is rotated about the longitudinal axis such that a chemical inlet passage of the valve is aligned with the rinsing liquid passage and the valve blocks the chemical passage. The rinsing liquid is applied to the target surface. The valve is rotated about the longitudinal axis such that the valve blocks the rinsing liquid passage and the chemical passage.

Another embodiment of the present invention is a sprayer head assembly for connection to a container that defines a cavity for storing a chemical to be sprayed. The sprayer head assembly comprises a chemical passage configured to be in communication with the cavity. A carrier fluid passage is configured to be in communication with a carrier fluid source. A valve chamber is configured to be in communication with the chemical and carrier fluid passages. A valve is moveably positioned within the valve chamber between at least a first position and a second position. The valve defines a first passage and a second passage that is in communication with the first passage. The valve is configured such that, in the first position, the valve blocks the chemical and carrier fluid passages, and in the second position, the first passage is configured to be in communication with the carrier fluid passage and the second passage is configured to be in communication with the chemical passage. The valve is configured to rotate about a first axis that is parallel to the carrier fluid passage.

Another embodiment of the present invention is a sprayer head assembly for connection to a container that defines a cavity for storing a chemical to be sprayed. The sprayer head assembly comprises a chemical passage configured to be in communication with the cavity. A carrier fluid passage is configured to be in communication with a carrier fluid source. A valve chamber is configured to be in communication with the chemical and carrier fluid passages. A valve is moveably positioned within the valve chamber between at least a first position, a second position and a third position. The valve defines a first passage, a second passage and a chemical inlet passage that is in communication with the second passage. The valve is configured such that, in the first position, the valve blocks the chemical and carrier fluid passages, in the second position, the first passage is configured to be in communication with the carrier fluid passage while the valve blocks the chemical fluid passage, and in the third position, the second passage is configured to be in communication with the carrier fluid passage and the chemical inlet passage is configured to be in communication with the chemical passage. The valve rotates about a longitudinal axis and is nested within the valve chamber such that the valve is prevented from moving radially with respect to the longitudinal axis by the valve chamber.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

BRIEF DESCRIPTION OF THE DRAWINGS

These and other features of the invention will now be described with reference to the drawings of the preferred embodiments, which are intended to illustrate and not to limit the invention, and in which:

FIG. 10 is a cross-sectional view of the sprayer head assembly in the "chemical" position;

FIG. 10A is an enlarged view of a portion of the sprayer head assembly of FIG. 10;

FIG. 11 is a front view of the sprayer head assembly in the closed position;

FIG. 25 is a front cross-sectional view of the sprayer head assembly of FIG. 23;

FIG. 26 is a side cross-sectional view of the sprayer head assembly of FIG. 23;

DETAILED DESCRIPTION OF THE PREFERRED EMBODIMENT

Figure 1:
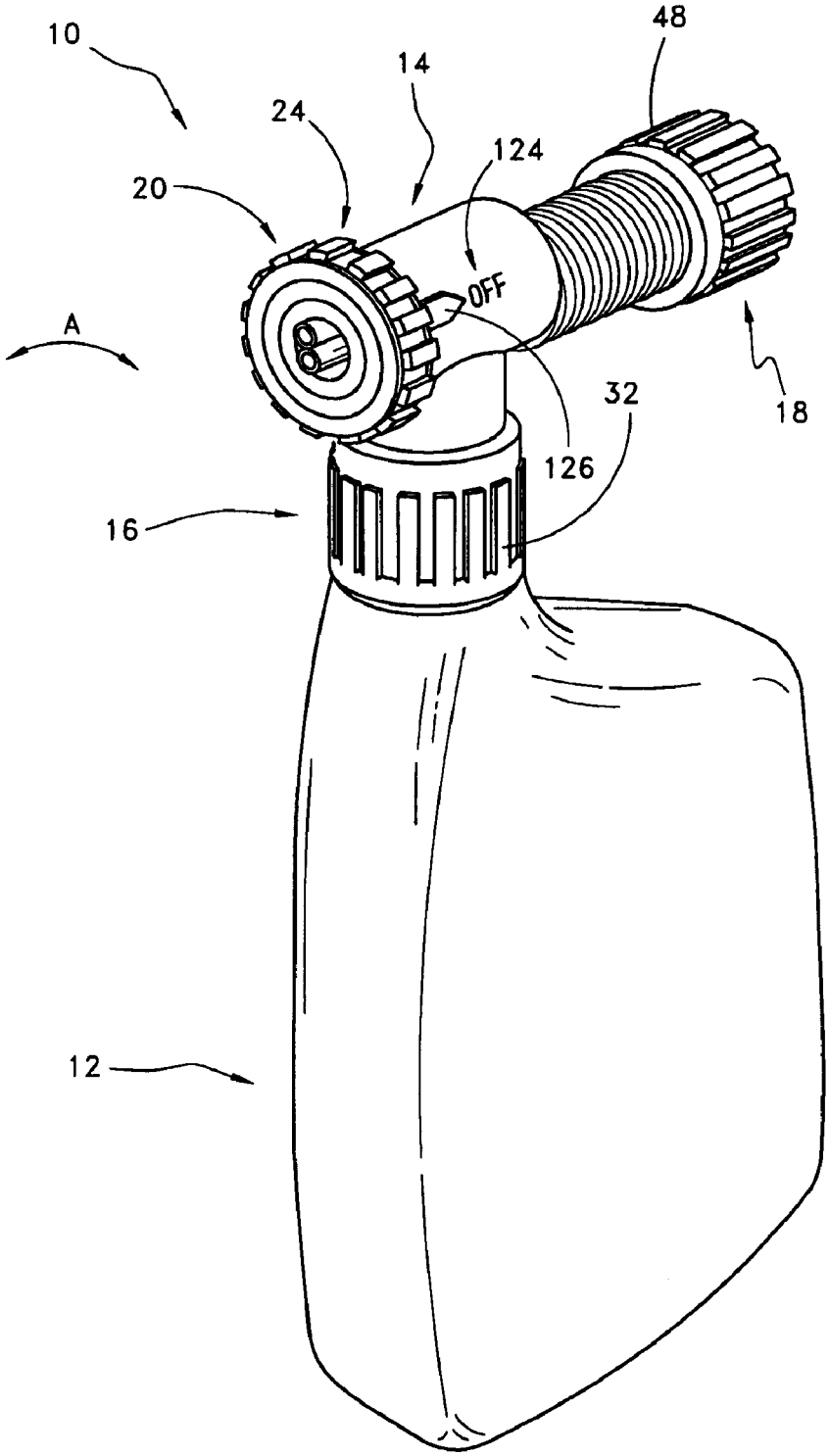
FIG. 1 is a perspective view of a first embodiment of a sprayer head assembly.
Figure 2:
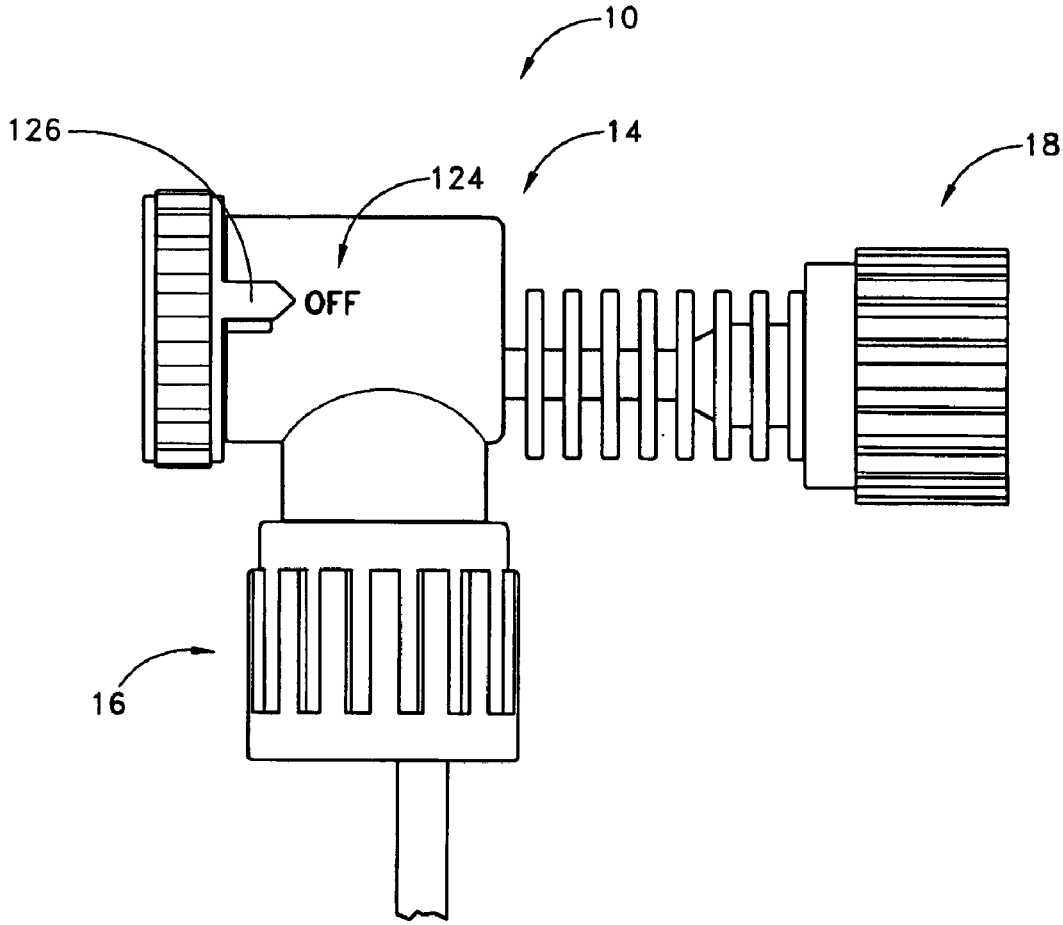
FIG. 2 is side view of the sprayer head assembly of FIG. 1 in an "off" position.
Figure 3:
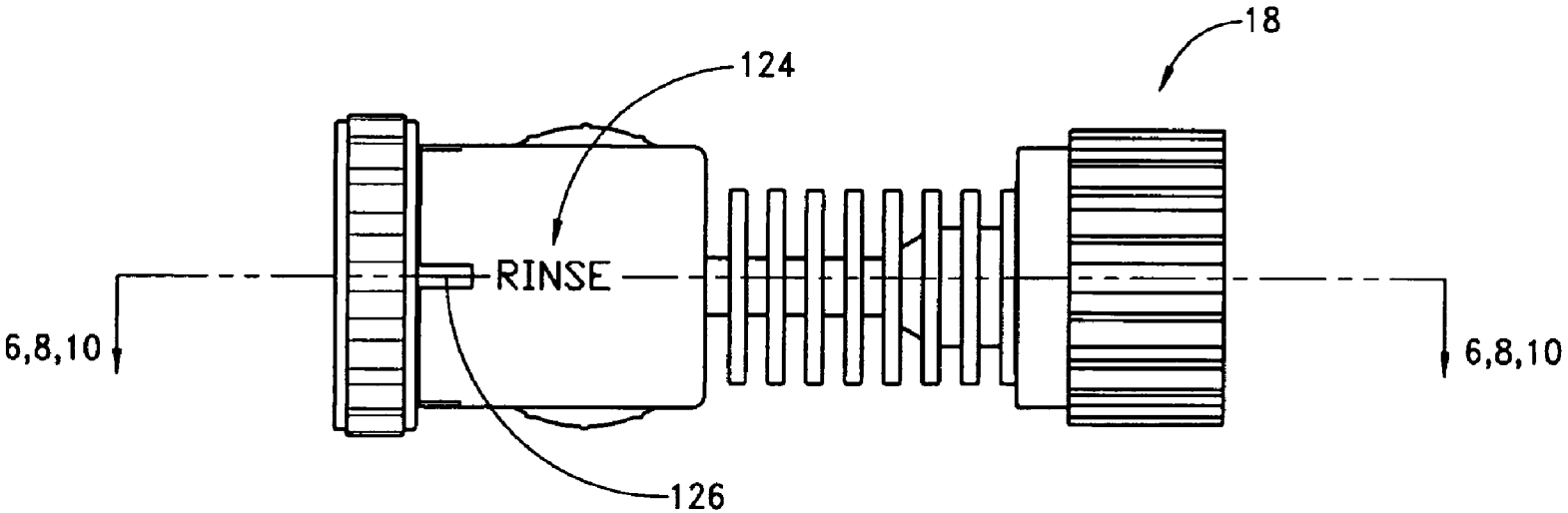
FIG. 3 is a top view of the sprayer head assembly of FIG. 1 in a "rinse" position.
Figure 4:
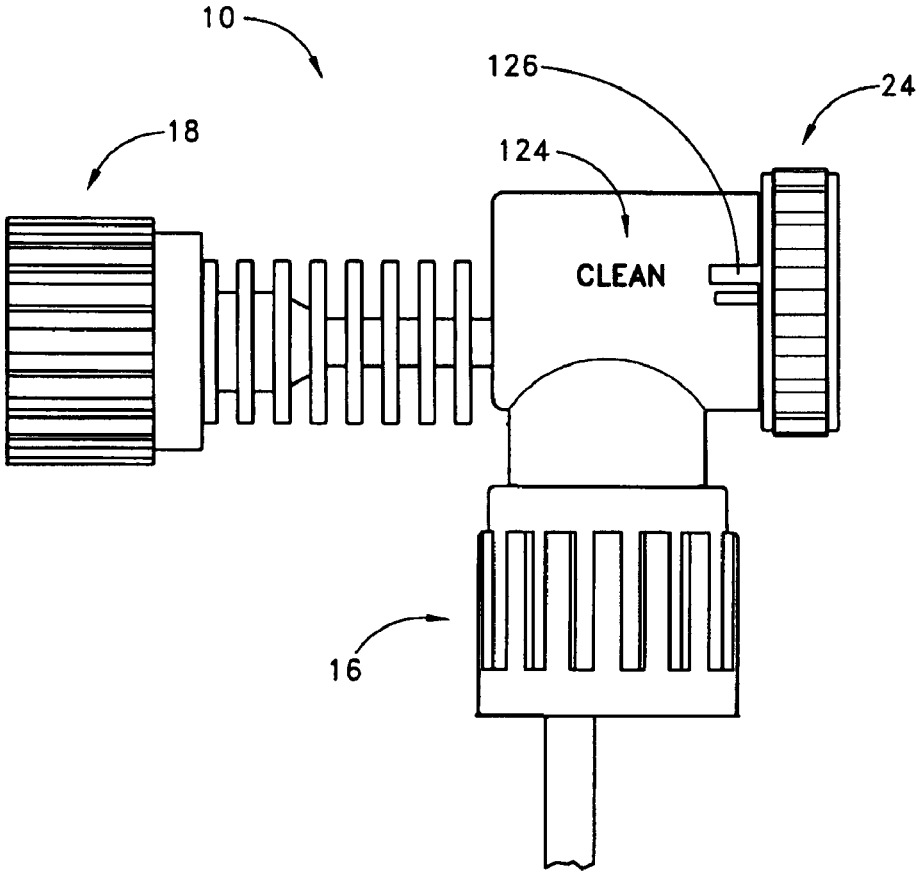
FIG. 4 is another side view of a different side of the sprayer head assembly of FIG. 2 in a "chemical" position.
Figure 5:
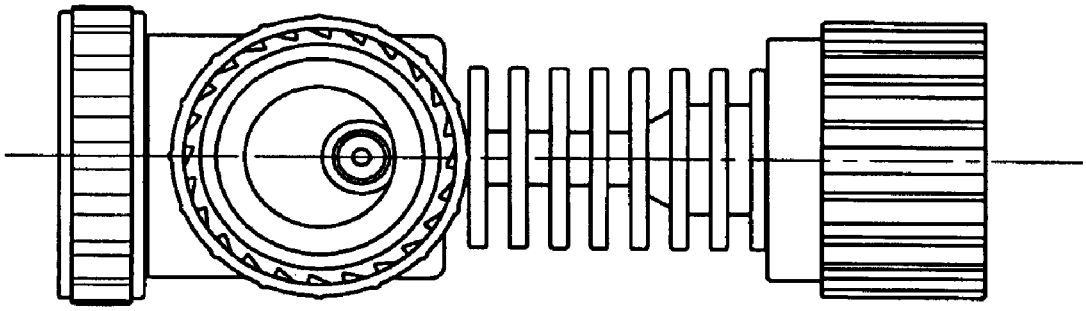
FIG. 5 is a bottom view of the sprayer head assembly of FIG. 1.

A sprayer head assembly 10 according an exemplary embodiment of the present invention is illustrated in FIGS. 1–12B. As shown in FIG. 1, the sprayer head assembly 10 is connected to a chemical container 12. The sprayer head assembly 10 includes a sprayer head 14, a container connection portion 16, a supply fluid connection portion 18, and a rotatable control valve 20. The sprayer head assembly 10 may be made of any suitable material that is resistant to and compatible with the chemical fluid to be sprayed. However, a flexible plastic material, such as polypropylene, is preferred because it is resilient yet durable.

With reference to FIGS. 1, 6 and 12A–B, the valve 20 is moveably positioned in a generally cylindrical bore 22 that is formed in the sprayer head 14 of the sprayer head assembly 10. The valve 20 includes a gripping area 24 that is preferably part of a distal end 26 of the valve 20, which, when the valve is inserted into the cylindrical bore, extends distally past a distal end 28 of the cylindrical bore 22. As will be explained in more detail below, an operator may move the valve 20 between at least three positions (e.g., "closed", "rinse" and "chemical") by gripping the gripping area 24 and rotating the valve 20 within the cylindrical bore 22.

The valve 20, bore 22, and gripping area 24 are illustrated as being arranged substantially about a longitudinal axis 30 of the sprayer head 14. This longitudinal arrangement of the valve 20, bore 22, and gripping area 24 is preferred because it allows the operator to rotate the valve 20 in an ergonomical position. That is, the operator can hold the container 12 in one hand and rotate the valve 20 with the other hand without excessive rotation and lifting of the elbows and shoulders. In comparison, if the valve 20 is arranged in a vertical position, the operator typically has to lift and twist the operator's shoulders and elbows in order to rotate a valve 20. However, those of ordinary skill in the art will recognize that some of the aspects of the present invention may be achieved with the valve 20 arranged along a non-longitudinal axis. The construction the valve 20 and bore 22 will be described in more detail below.

Figure 6:
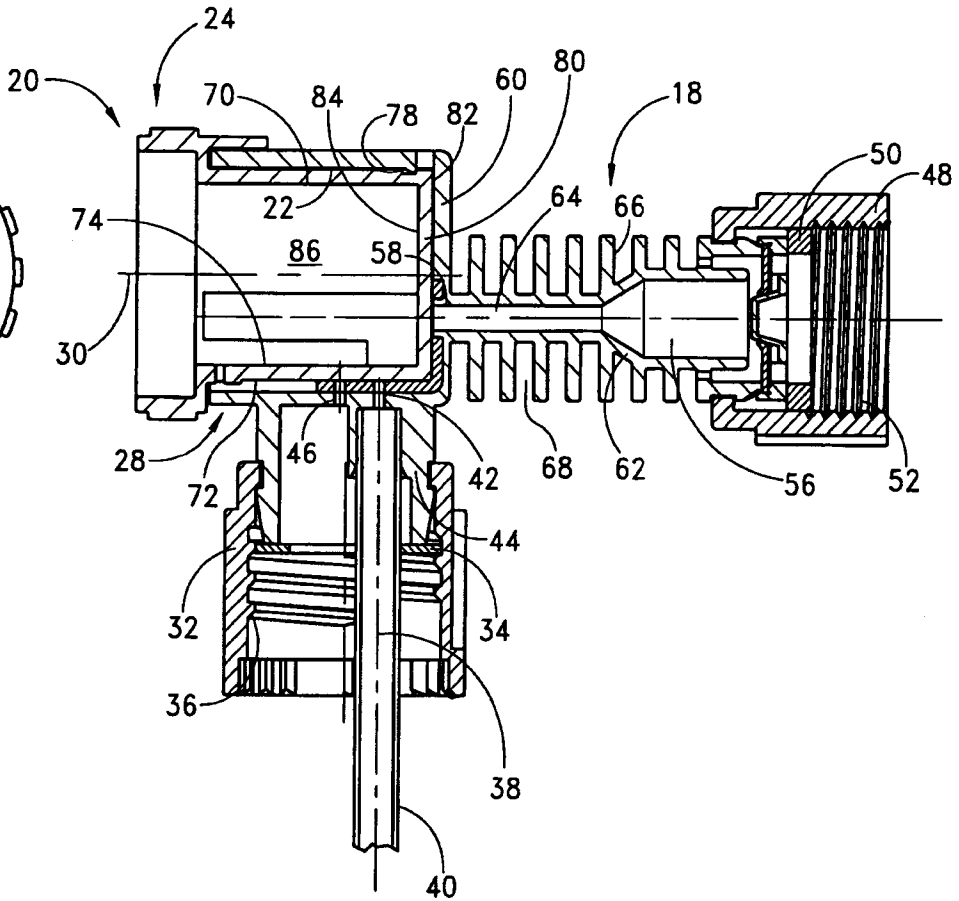
FIG. 6 is a cross-sectional view of the sprayer head assembly in the "off" position.

With continued reference FIGS. 1 and 6, the connection between the sprayer head assembly 10 and the container 12 can be achieved by providing the container connection portion 16 with a conventional rotatable coupler 32 and a washer 34. The rotatable coupler 32 includes internal threads 36 that cooperate with corresponding threads (not shown) formed on the neck of the container 12.

The sprayer head assembly 10 can also be permanently attached to the container 12. In such an arrangement, adhesive can be applied to the inner surface of the connection portion 16 before it is fitted over the neck of the container 12. Alternatively, the connection portion 16 can include an inwardly projecting ratchet that opposes a cooperating ratchet formed on the container 12.

With particular reference to FIG. 6, when the sprayer head assembly 10 is installed onto the container 12, the interior of the container 12 is in communication with a chemical passage 38 that is also in communication with the interior of the cylindrical bore 22. In the illustrated arrangement, the chemical passage 38 is defined in part by a downwardly depending chemical flow tube or dip tube 40. The dip tube 40 extends into the container 12 and preferably terminates near a bottom surface of the container 12. The chemical passage 38 is also defined in part by an internal passage 42, which is formed in the sprayer head 14. The internal passage 42 communicates with the interior of the cylindrical bore 22 and the dip tube 40. The dip tube 40 is secured in fluid communication with the internal passage 42 by a sleeve 44. Although, in the illustrated arrangement the chemical passage 38 is defined by two components (the dip tube 40 and the internal passage 42), it should be appreciated that the chemical passage 38 can be defined by a single component or more than two components. The illustrated arrangement, however, is preferred because it is easy to manufacture and yet uses a small number of components. It should also be appreciated that in the illustrated arrangement the chemical passage 38 defines a flow path that is generally perpendicular to the longitudinal axis 30 of the sprayer 10.

Preferably, the sprayer head assembly 10 includes a vent passage 46, which is best seen in FIG. 6. In the illustrated arrangement, the vent passage 46 is formed in the head 14 of the assembly 10. As with the chemical passage 38, the vent passage 46 communicates with the interior of the container 12 when the assembly 10 is mounted onto the container 12. The vent passage 46 extends up through head 14 and communicates with the interior of the cylindrical bore 22. The vent passage 46 lies generally parallel to (and spaced along the axis 30 of the valve 20 from) the internal passage 38. Although, in the illustrated arrangement the vent passage 46 is formed on the assembly 10, it should be appreciated that the vent passage 46 can be located on the container 12. However, the illustrated arrangement is preferred because, as will be explained below, it enables the vent passage 46 to be opened and closed by the valve 20.

With continued reference to FIG. 6, the sprayer head assembly 10 also includes the carrier fluid connection portion 18. The carrier fluid connection portion 18 connects the assembly 10 to a pressurized carrier fluid source (not shown), such as, for example, a garden hose. In the illustrated arrangement, the connection is formed by a conventional rotatable coupler 48 and a washer 50. The coupler 48 includes threads 52 that cooperate with corresponding threads (not shown) formed on the supply fluid source. One of ordinary skill in the art will appreciate that other means can be used to connect the assembly 10 to the carrier fluid source.

The sprayer head assembly 10 includes a carrier fluid passage 56. The carrier fluid passage 56 is in communication with the carrier fluid source and the interior of the bore 22 through an opening 58 formed by an end wall 60 of the bore 22. In the illustrated arrangement, the supply passage 56 is defined in part by a side wall 62, which extends from the end wall 60 to the coupler 48 of the sprayer head 14. The supply passage 56 preferably includes an elongated constriction passage 64, which in the preferred embodiment directly communicates with the cylindrical bore 22. The elongated constriction passage 64 helps to produce a uniform, non-turbulent stream of carrier fluid into the bore 22. It should be appreciated that the supply passage 56 can be defined by a single component or more than two components, which can be integrated together or made separately. The illustrated arrangement is preferred because it is relatively simple to form and produces the desired uniform stream of carrier fluid. It should also be appreciated that the opening 58 defines a carrier fluid axis that is generally parallel to the longitudinal axis 30 of the sprayer 10.

In the illustrated arrangement, the side wall 62 is reinforced with a plurality of annular rings 66, which are separated by gaps 68. The rings 66 strengthen the side wall 62 while the gaps 68 reduce the amount of material required to form the supply fluid connection portion 18 and provide a larger grip area.

Figure 12B:
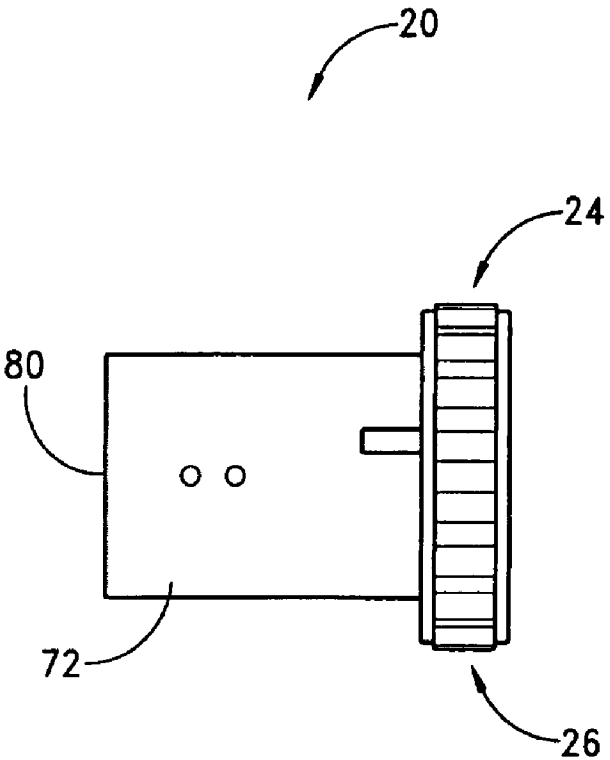
FIG. 12B is another side view from an opposite side of the control valve.
Figure 12A:
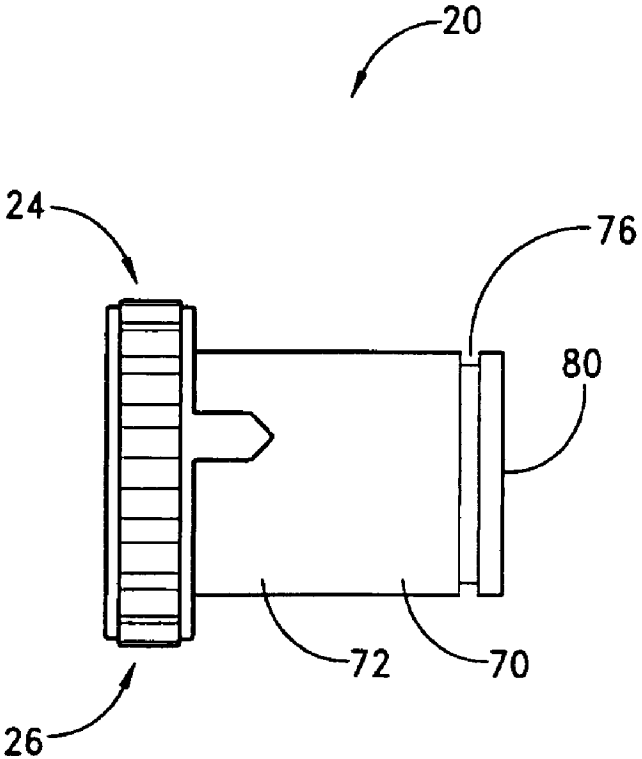
FIG. 12A is an side view of a control valve.
Figure 13:
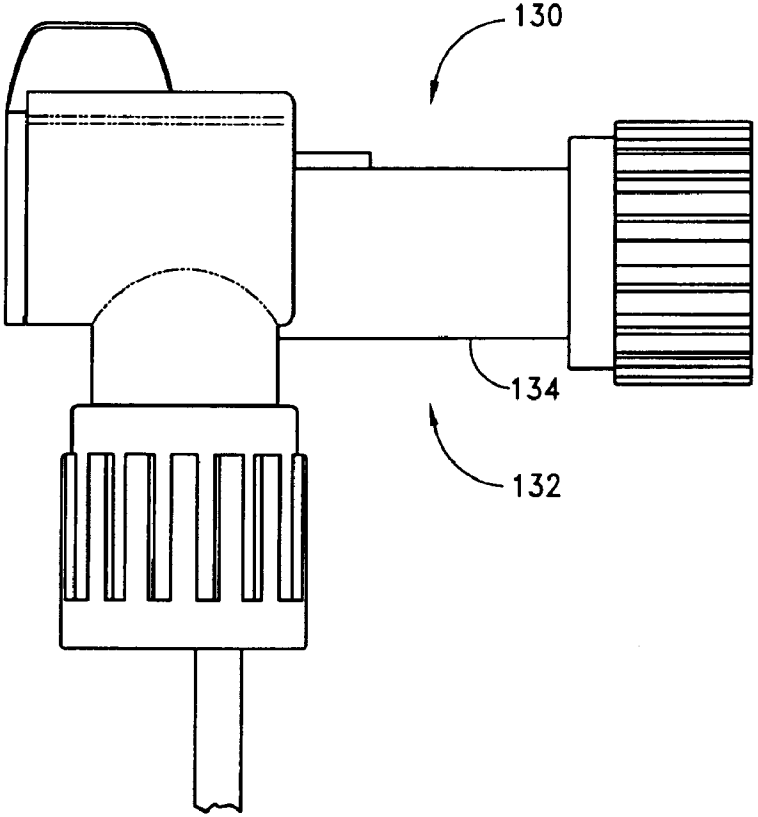
FIG. 13 is a side view of a modified embodiment of a sprayer head assembly.

As best seen in FIGS. 6 and 12A–B, in the illustrated arrangement, the valve 20 comprises a generally cylindrical side wall 70, which defines a outer surface 72 for sliding engagement with the cylindrical bore 22 and an inner surface 74. Preferably, the outer surface 72 includes an annular groove 76, which is configured to engage an annular ridge 78 (see FIG. 6) that is formed along the inner bore 22. Accordingly, the valve 20 is inserted into the sprayer head 14 by snap-fitting the valve 20 over the annular ridge 78. Once snap-fitted, the valve 20 can rotate within the cylindrical bore 22 but is secured axially by the engagement of the annular ridge 78 with the annular groove 76. In-modified embodiments, the valve 20 may include a ridge while the bore may include a groove. In the illustrated embodiment, the annular ridge 78 does not extend completely around the bore 22. In a similar manner, the annular groove 76 also does not extend completely around the valve 20. In this manner, the annular groove 76 and ridge 78 can be used to orient the valve 20 about the axis 30 and to limit the rotation of the valve 20 within the bore 22. Of course in a modified arrangement, the annular groove 76 and the ridge 78 can extend completely around the valve 20 and bore 22.

The valve 20 includes a proximal end wall 80, which lies adjacent or near the end wall 60 of the cylindrical bore 22. The end wall 80 includes outer and inner surfaces 82, 84. As such, the illustrated valve 20 is cup-shaped with the inner surfaces 74, 84 of the side wall 70 and end wall 80 defining an inner space 86 which is open opposite the end wall 80.

Figure 8:
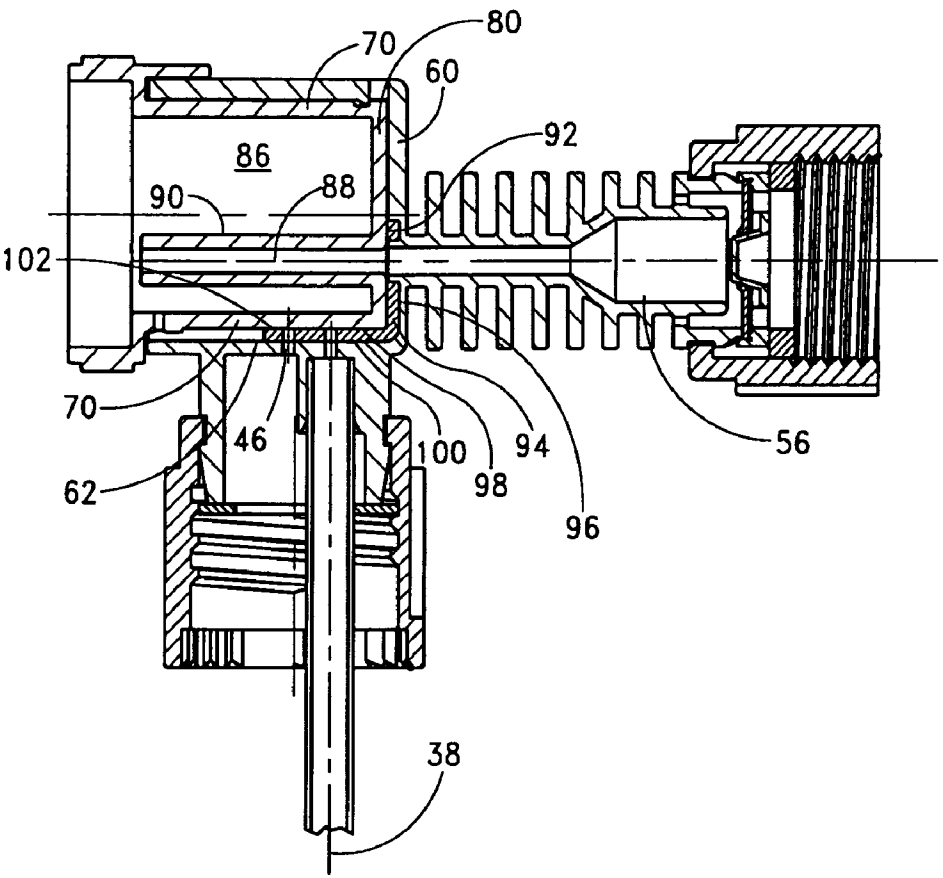
FIG. 8 is a cross-sectional view of the sprayer head assembly in the "rinse" position.
Figure 9:
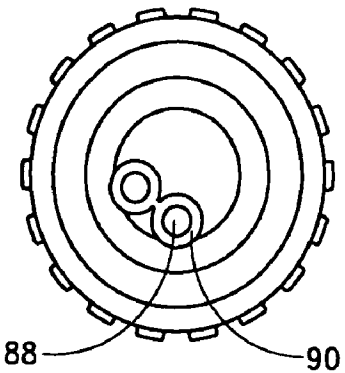
FIG. 9 is a front view of the sprayer head assembly in the "rinse" position.

As best seen in FIGS. 8 and 9, the valve 20 defines at least in part a first passage 88. The first passage 88 is configured and positioned within the valve 20 such that when the valve 20 is a "rinse" position (i.e., the position shown in FIGS. 8 and 9) the first passage 88 is aligned with and communicates with the carrier fluid passage 56 through the opening 58 in the end wall 60. In the illustrated arrangement, the first passage 88 is defined by a tubular member 90, which extends from the end wall 80 of the valve 20. The bore 22 preferably includes a carrier fluid sealing portion 92 that forms an annular seal around the interface between the carrier fluid passage 56 and the first passage 88. Accordingly, the connection between the carrier fluid passage 56 and the first passage 88 is sealed and carrier fluid is prevented from leaking into the gaps between the valve 20 and the cylindrical bore 22.

The carrier fluid sealing portion 92 is preferably formed from a separate sealing member 94 that is positioned within a recess 96 formed on the end wall 60 of the bore 22. The sealing member 94 is preferably made of a soft plastic elastomer material or a suitable synthetic rubber material. Such material provides an effective seal with the valve 20, which is preferably made of a harder plastic material. In the illustrated arrangement, the carrier fluid passage 56, therefore, extends through the sealing member 94 such that the end of the carrier fluid passage 56 is generally adjacent to the entrance to the first passage 88. That is, the sealing member 94 defines a transition passage, which lies between the carrier fluid passage 66 and the first passage 88. In a modified arrangement, the carrier fluid sealing portion 92 may be positioned around and distanced from the interface between carrier fluid passage 56 and the first passage 88. In another embodiment, the carrier fluid sealing portion 92 may be positioned on the valve 20 and/or the sealing member 94 may be positioned within a recess formed on the valve 20. In still another embodiment, the carrier fluid sealing portion 92 can be formed by more than one sealing member.

With continued reference to FIG. 8, in the rinse position, the side wall 70 of the valve 20, blocks the chemical passage 38. The bore 22 preferably includes a chemical sealing portion 98, which forms an annular seal around the interface between chemical passage 38 and the valve 20. In this manner, the valve 20 and the chemical sealing portion 98 prevent chemicals from leaking into the gaps between the valve 20 and the bore 22. In the illustrated embodiment, the sealing member 94 forms chemical sealing portion 98 and positioned within a recess 100 formed in the side wall 62 of the inner bore 22. However, it should be appreciated that the chemical sealing portion 98 can be formed from a second sealing member positioned on the bore 22 or the valve 20 or more than one sealing member. In addition, the illustrated sealing member 94 defines a portion of the chemical passage 38.

In the rinse position, the side wall 70 of the valve 20 preferably also blocks the vent passage 46. Moreover, the inner bore 22 includes a vent sealing portion 102 that forms an annular seal around the interface between the vent passage 46 and the outer wall 70. In the illustrated embodiment, the sealing member 94 forms the vent sealing portion 102 and also forms a part of the vent passage 46. In modified embodiments, the sealing member 94 may be distanced from and extend around the vent passage 46, the vent sealing portion 102 may be formed by a different sealing member, more than one sealing member, and/or the vent sealing portion 102 may be positioned on the valve 20.

With reference now to FIGS. 10 and 11, the valve 20 in shown in a "chemical" position. The valve 20 defines a second passage 104. The second passage 104 is configured and positioned within the valve 20 such that when the valve 20 is a "chemical" position the second passage 104 is aligned with and communicates with the supply fluid passage 56. In the illustrated arrangement, the second passage 104 is defined by a second tubular member 106, which extends from a second opening formed in the proximal end wall 80 of the valve 20. The second passage 104 includes a small diameter portion 108 and a large diameter portion 110. As best seen in FIG. 10A, a backward facing step or shoulder 112 is formed at the interface between the small and large diameter portions 108,110. In a modified arrangement, the tubular member 106 may include one or more holes (not shown) that are open to atmospheric pressure. Such holes may reduce the amount of material required to manufacture the valve 20 without causing leakage.

As with the "rinse" position, the carrier fluid sealing portion 92 forms an annular seal around the interface between the carrier fluid passage 56 and the second passage 104. Accordingly, the connection between the carrier fluid passage 56 and the second passage 104 is sealed and supply fluid is prevented from leaking into the gaps between the valve 20 and the cylindrical bore 22. As mentioned above, in the illustrated embodiment, the carrier fluid sealing portion 92 is formed by the sealing member 94. However, in modified embodiments, the fourth sealing portion 100 can be formed from a different sealing member, more than one sealing member, and/or one or more sealing members positioned on the valve 20. The illustrated supply fluid passage 56 also extends through the sealing member 94. However, in modified embodiments, the sealing member 94 can define a transition passage, which connects the second passage 104 to the supply fluid passage 56 or the sealing portion can extend around the interface between the supply passage 56 and the second passage 104.

The valve 20 also defines a chemical inlet passage 114, which is configured and positioned within the valve 20 such that when the valve 20 is the chemical position the chemical inlet passage 114 is aligned with and communicates with the chemical passage 38. As illustrated in FIG. 10, the interface between the chemical inlet passage 114 and the chemical passage 38 is sealed by the chemical sealing portion 98 that, in the illustrated embodiment, is defined by the sealing member 94 as described above. In modified embodiments, the chemical sealing portion 98 may be formed from a different sealing member, more than one sealing member, and/or one or more sealing members positioned on the valve 20. The illustrated chemical passage 38 extends through the sealing member 94. However, in modified embodiments, the sealing member 94 may define a transition passage, which connects the chemical inlet passage 114 to the chemical passage 38 or the chemical sealing portion can extend around the interface between the chemical passage 38 and the chemical inlet passage 114.

As best seen in FIG. 10A, the chemical inlet passage 114 defines a metering orifice 115 that terminates at an opening 116, which is preferably located adjacent but down stream of the step or shoulder 112 in the second passage 104. As carrier fluid flows through the second passage 104 and past the step 112, a suction force is created which draws the chemical from the container 12 through the chemical passage 38 and into the second passage 104 where it is mixed with the carrier fluid.

As is known in the art, the diameter of the metering orifice 115 in the illustrated embodiment) and the mouth 116 determines, for the most part, the dilution ratio of the sprayer head assembly 10. The method for determining the diameter of the metering orifice 115 and mouth 116 to achieve a desired dilution ratio are well known to those of ordinary skill in the art; therefore, a detailed description of such a method is not necessary. In a modified arrangement, the metering orifice 115 can be formed by the chemical inlet passage 114.

With continued reference to FIG. 10, the valve 20 includes a fourth passage 118. When the valve 20 is at the chemical position, the fourth passage 118 is aligned with the vent passage 46. The fourth passage 118 opens into the interior 86 of the valve 20, which is open to atmospheric pressure. In a modified arrangement, a groove (not shown) can be provided on the outer surface of the valve 20. The groove becomes aligned with the vent passage 46 in the chemical position. The groove extends to the distal end of the valve 20 such that the vent passage 46 is open to atmospheric pressure.

Accordingly, when the valve 20 is in the open position, the vent passage 46 is in communication with an atmospheric pressure source. In the illustrated embodiment, the interface between the fourth passage 118 and the vent passage 46 is sealed by the vent sealing portion 102, which, in the illustrated embodiment, is defined by the sealing member 94. In modified embodiments, the vent sealing portion 102 can be formed from a different sealing member, more than one sealing member, and/or one or more sealing members positioned on the valve 20. The illustrated vent passage 46 extends through the sealing member 94. However, in modified embodiments, the sealing member 94 can define a transition passage, which connects the fourth passage 118 to the vent passage 46. The vent sealing portion 102 may extend around the interface between the vent passage 46 and the fourth passage 118.

Figure 7:
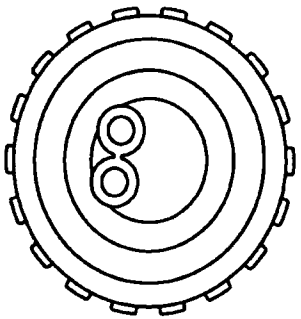
FIG. 7 is a front view of the sprayer head assembly in the "off" position.

As best seen in FIGS. 6 and 7, in the "closed" position, the proximal end wall 80 of the valve 20 blocks the carrier fluid passage 56 and the carrier fluid sealing portion 92 forms an annular seal around the interface between the carrier fluid passage 56 and the end wall 70. In a similar manner, the side wall 70 of the valve 20 blocks the chemical passage 38 and the vent passage 46 and the chemical and vent sealing portions 98, 102 form annular seals around the interfaces between the chemical and vent passages 38, 46 and the side wall 80. As such in the closed position, the carrier passage 56, chemical passage 38 and the vent passage 56 are all closed by the valve 20. Specifically, the end wall 80 blocks the carrier passage 46 while the side wall 70 blocks the chemical and vent passages 38, 46. The sealing portions 92, 98, 102 form a tight seal at the interface between these passages 56, 38, 46 and the valve 20 so as to and prevent leakage.

As mentioned above, in the illustrated arrangement, the sealing portions are formed by the sealing member 94, which is positioned within a recess 96 formed in the inner bore 22. This arrangement is preferred because it reduces the number of parts required to construct the assembly 10. However, as mentioned above, it should be appreciated that in other embodiments the sealing portions 92, 98, 102 may be formed from a plurality of sealing members 94 positioned within one or more recesses positioned on the inner bore 22 or the valve 20. It should also be appreciated that, although the illustrated sealing portions 92, 98, 102 are preferably formed from a separate sealing member 94, the sealing portions 92, 98, 102 can be integrated into the inner bore 22 and/or the valve 20 such that the sealing portions 92, 98, 102 and the inner bore 22 and/or the valve 20 form a single integrated part.

In the chemical position (see FIGS. 10 and 11), a stream of pressurized carrier fluid is discharged into the second passage 104. As the carrier fluid flows over the opening 116 and the step 112, a suction force is created that draws chemical through the dip tube 40, the chemical inlet passage 114 and into the stream of carrier fluid. Venting is provided through the vent passage 46 and the fourth passage 118. The chemical/carrier fluid mixture is discharged through an opening 120 in the second passage 104 and may be applied to a surface.

In the rinse position (see FIG. 8), a stream of pressurized carrier fluid is discharged from an opening 122 the first passage 88 without being mixed with the chemicals in the container 12. In this manner, the carrier fluid can be used to "rinse" the chemical/carrier fluid mixture from the surface. Of course, in a modified embodiment, the rinsing and chemical steps can be reversed.

As best seen in FIGS. 1–4, The assembly 10 preferably includes visual indicia 124 to indicate the position of the valve 20. In the illustrated embodiment, the visual indicia 124 comprises the words "OFF", "RINSE" and "CLEAN", which are placed on the housing 14. The valve 20 includes a tab 126, which for each of the three positions points to the appropriate visual indicia 124 on the housing. Of course, those of skill in the art will recognize that the visual indicia 124 may be modified in many different ways and that the visual indicia 124 may be placed on the valve 20 and the tab 126 may be coupled to the housing 14.

The illustrated assembly 10 described above is particularly adapted to be manufactured by injection molding. Because the assembly 10 will typically be discarded after the chemical in the container 12 is exhausted, the costs of manufacturing the assembly 10 must be low. Injection molding is a particularly low cost method of making parts out of plastic-type materials. Those of ordinary skill in the art will recognize that the sprayer head 14, the container connection portion 16, the supply fluid connection portion 18, the sealing member 94 and the rotatable control valve 20 can all be formed using injection molding.

To further reduce the cost of a aspirator-type sprayer, it is beneficial to use a minimum number of parts. The illustrated assembly 10 preferably includes only three main parts: the head 14, the control valve 20, and the sealing member 94. This represents a great improvement over sprayers that include a plurality of valves, multiple O-rings and multiple sealing members. Additionally, these parts may be relatively small using less plastic and smaller molds, further decreasing costs. Furthermore, the illustrated assembly 10 is easily assembled. The two main assembling steps are (i) placing the sealing member 94 into the recess 96 on the inner core 22 and (ii) snap-fitting the valve 20 into the valve chamber 22.

Because of safety concerns, it is preferable that an aspiration-type sprayer not leak. One of ordinary skill in the art will appreciate that the illustrated assembly 10 described above meets this requirement. In particular, the arrangement of the sealing member 94 in the bore adequately prevents chemicals from leaking.

Another advantage of the illustrated embodiments is that the valve 20 is nested within the sprayer head 14. That is, the cylindrical bore 22 prevents radial movement of the valve 20 with respect to the longitudinal axis 30. Preferably, the cylindrical bore 22 extends completely (i.e., 360 degrees) around the portions of the valve 20 that lie adjacent the sealing member 94. This arrangement is preferred because it protects the sealing member 94 from damage that may be caused by dirt or water that may become trapped in between the valve 20 and the bore 22.

FIGS. 13–19 illustrate another exemplary embodiment of a sprayer head assembly 130, wherein components that are similar to components of the assembly 10 illustrated in FIGS. 1–12 are given the same reference numbers.

Figure 16:
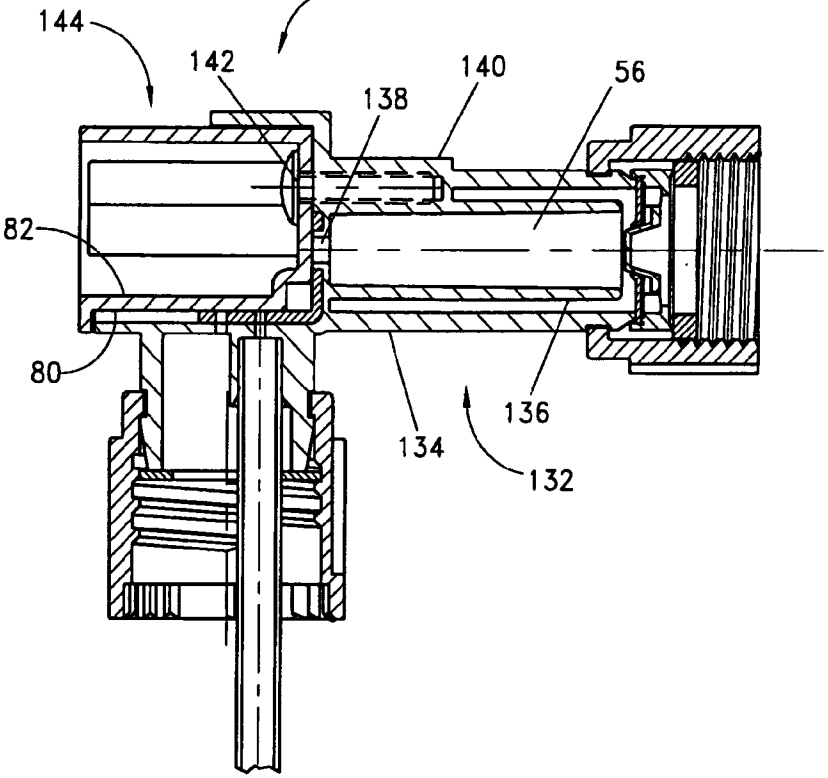
FIG. 16 is a cross-sectional view of the sprayer head assembly of FIG. 13 in an off position.
Figure 17:
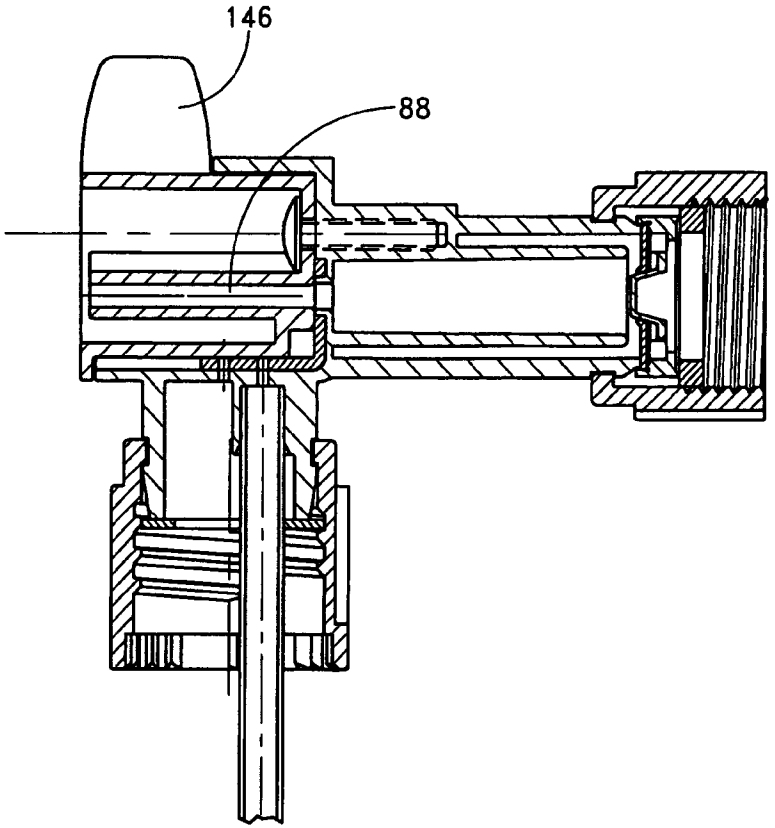
FIG. 17 is a cross-sectional view of the sprayer head assembly of FIG. 13 in a rinse position.
Figure 18:
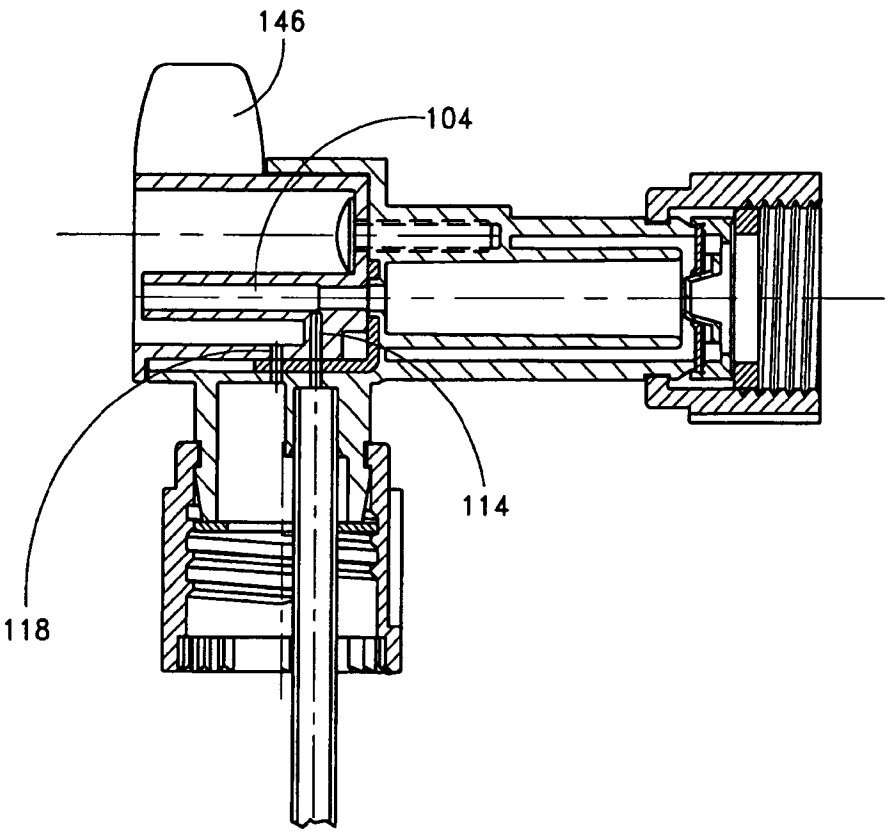
FIG. 18 is a cross-sectional view of the sprayer head assembly of FIG. 13 in a chemical position.
Figure 19:
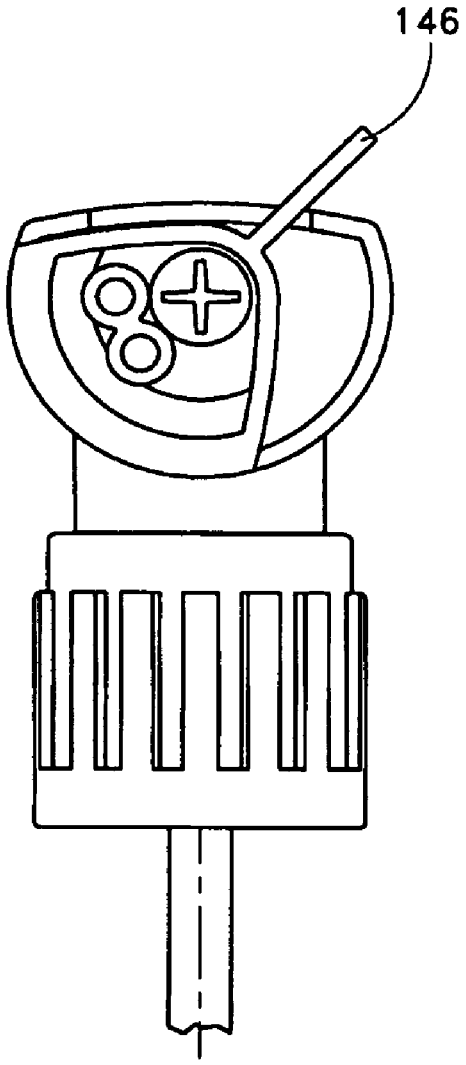
FIG. 19 is a front view of the sprayer head assembly of FIG. 13.

In this embodiment, the assembly 130 includes a carrier fluid section 132, which is formed from a generally cylindrical outer member 134 that does not include reinforcing rings (see FIG. 16). The carrier fluid section 132 includes a tubular member 136, which is positioned in the generally cylindrical outer member 134 and defines a portion of the carrier fluid passage 56. A constriction 138 in the carrier fluid passage 56 is defined by the housing 14 and is, is therefore, significantly shorter than the constriction 64 of the assembly of FIGS. 1–12. The cylindrical outer member 134 preferably defines a boss 140 for receiving a screw 142, which is used to attach the valve 144 to the housing 12 as will be explained in more detail below.

As with the previous embodiment, the valve 144 is generally cylindrical and defines an outer surface 80, inner surface 82, a first passage 88, a second passage 104, a chemical inlet passage 114 and a fourth passage 118 arranged substantially as described above. However, in this embodiment, the valve 144 is secured to the housing by the screw 142, which extends through the end wall 80 and into the boss 140. As such, the valve 144 is not snap-fitted into the inner bore 22 but is instead is inserted into the bore 22 and secured with the screw 142.

Figure 14:
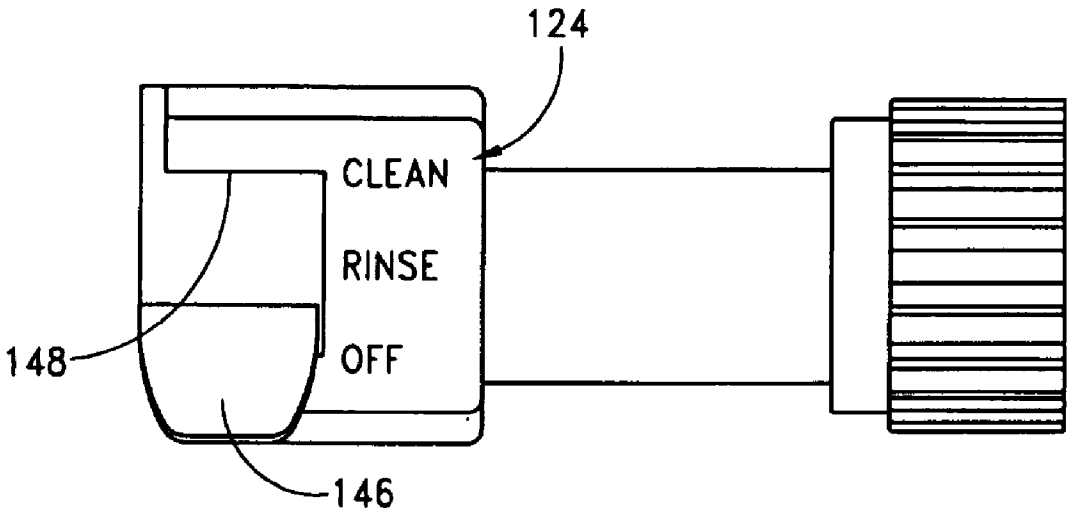
FIG. 14 is a top view of the sprayer head assembly of FIG. 13.
Figure 15:
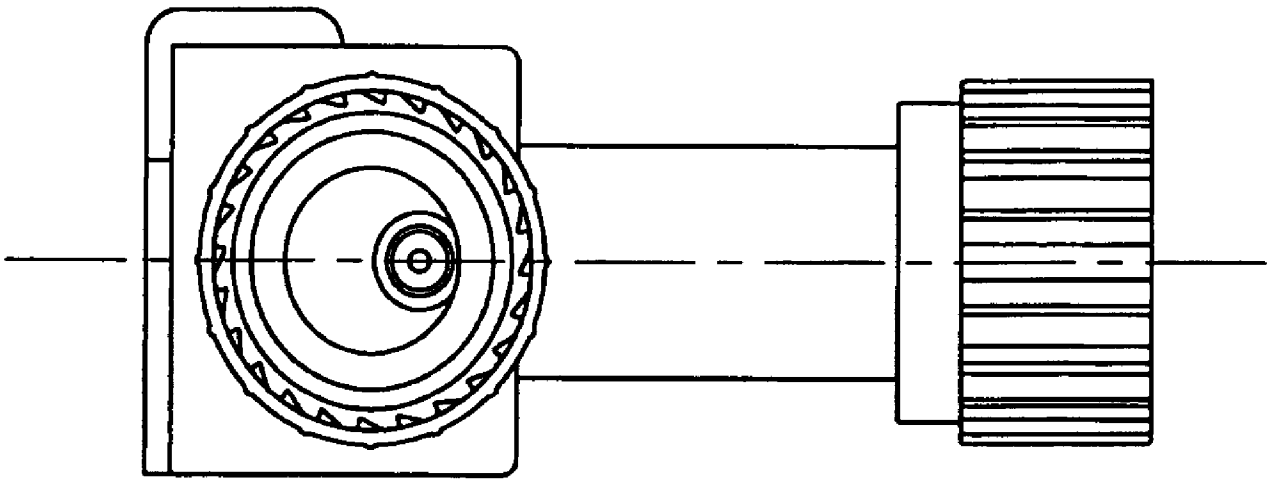
FIG. 15 is a bottom view of the sprayer head assembly of FIG. 13.

The illustrated embodiment also includes a tab 146, which extends outwardly from the side wall 70 of the valve 144. The tab 146 serves as both the holding area and the pointer to the visual indicia 124 as best seen in FIG. 14. The tab 146 extends through a channel 148 formed in the housing 14. The channel 148 limits the rotation of the valve between the off, rinse and chemical positions.

Figure 20:
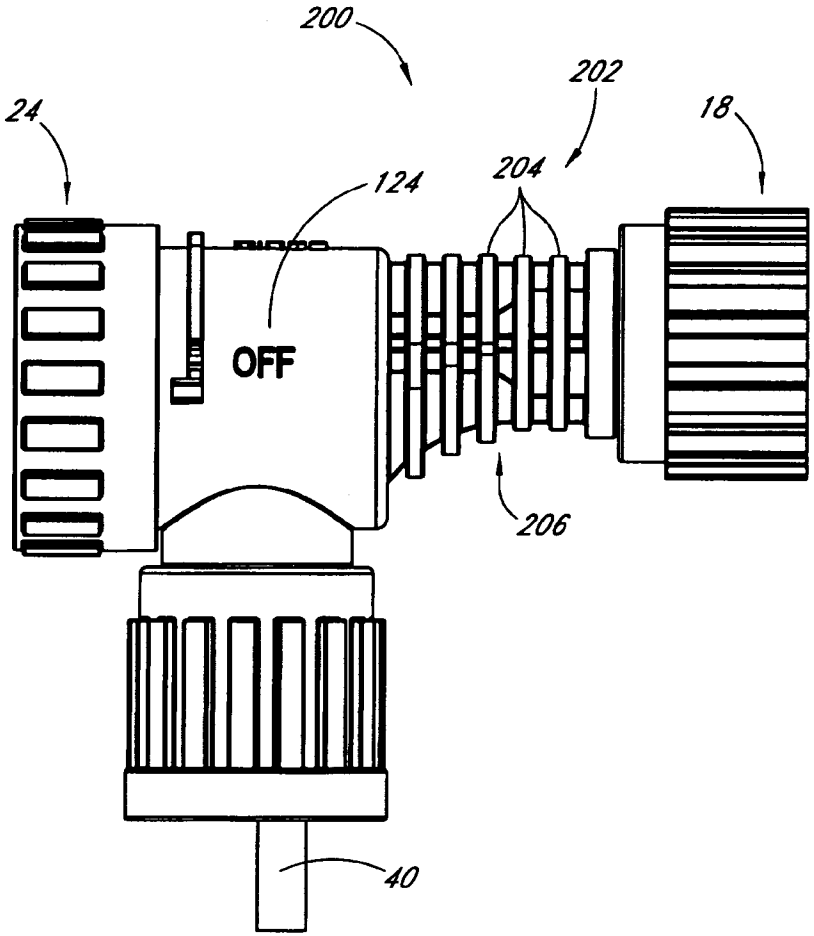
FIG. 20 is a side view of another modified embodiment of a sprayer head assembly.
Figure 21:
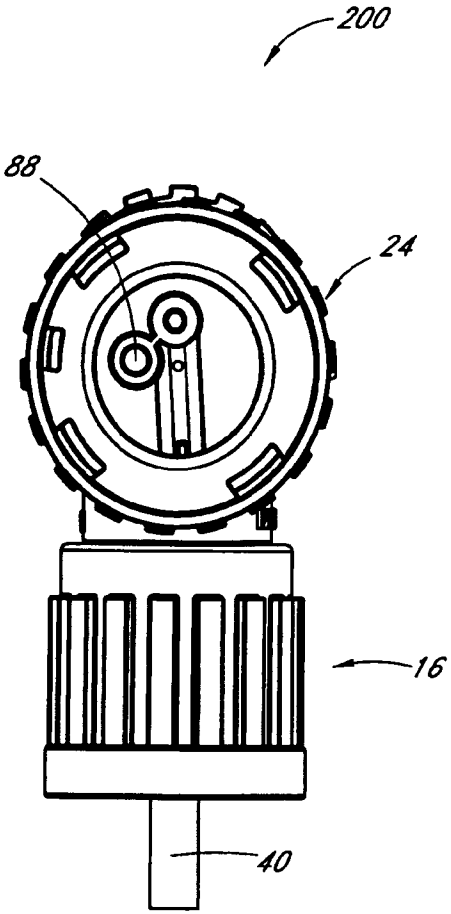
FIG. 21 is a front view of the sprayer head assembly of FIG. 20.
Figure 22:
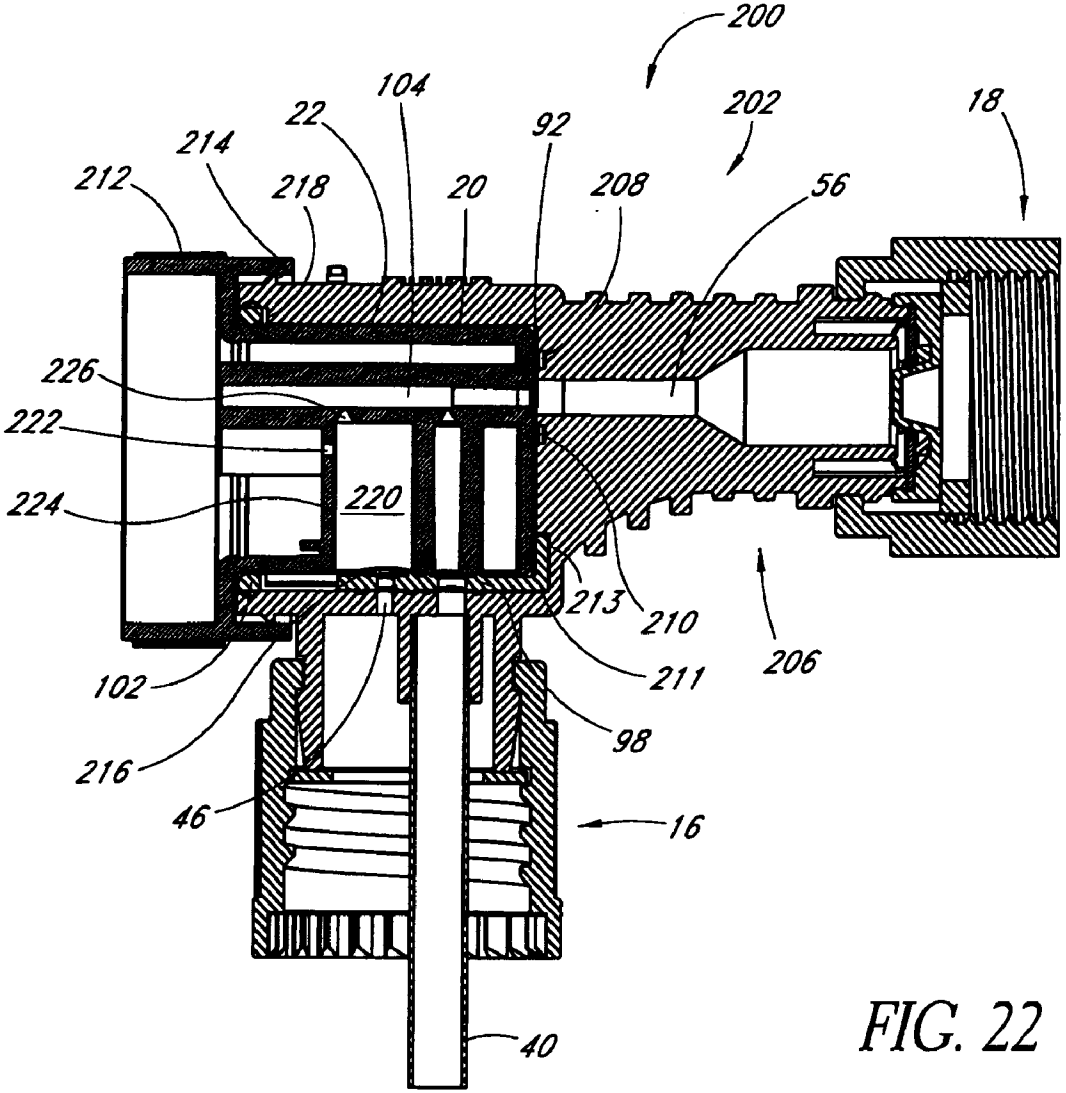
FIG. 22 is a cross-sectional view of the sprayer head assembly of FIG. 20 in a chemical position.

FIGS. 20–22 illustrate another exemplary embodiment of a sprayer head assembly 200, wherein components that are similar to components of the assembly 10 illustrated in FIGS. 1–12 are given the same reference numbers.

In this embodiment, the assembly 200 includes a carrier fluid section 202, which includes reinforcing rings 204 (see FIGS. 20 and 22). An underside portion 206 of the carrier fluid section 202 is curved to provide an ergonomic grip for the hand of a user. That is, in one arrangement, the user holds the assembly 200 by gripping the carrier fluid section such that the index and middle fingers wrap around and under the carrier fluid section 202. The curved underside portion 206 provides the carrier fluid section 202 with a larger circumference at the point where the index and middle fingers wrap around, which enhances the grip of the user.

With reference to FIG. 22, in the illustrated arrangement, the carrier fluid sealing portion 92 is formed from an O-ring 208 that is positioned within a annular groove 210 formed in the cylindrical bore 22. The O-ring 208 forms an annular seal around the interface between the carrier fluid passage 56 and the first passage 88 (see FIG. 21) of the valve 20. Accordingly, the connection between the carrier fluid passage 56 and the first passage 88 is sealed and carrier fluid is prevented from leaking into the gaps between the valve 20 and the cylindrical bore 22. In this embodiment, the chemical sealing portion 98 and the vent sealing portion 102 are formed by a single sealing member 211, which is placed within a recess 213 formed on the cylindrical bore 22. Advantageously, the illustrated embodiment, only utilizes two sealing members to form the carrier fluid, chemical, and vent sealing portions 92, 98, 102.

The illustrated valve 20 also includes an outer flange 212 (see FIG. 21), which is configured to snap over an annular ridge 214 formed on the outer surface of the sprayer head 14. Accordingly, the valve 20 maybe be inserted into the sprayer head 14 by snap-fitting the flange 212 over the annular ridge 214. Once snap-fitted, the valve 20 can rotate within the cylindrical bore 22 but is secured axially by the engagement of the annular ridge 214 with the annular flange 212. In modified embodiments, the flange 212 may include a groove for receiving the ridge 214. In other embodiments, the flange 212 may include a ridge configured to be received within a groove provided on the sprayer head 14.

The illustrated arrangement preferably also includes an O-ring 216 positioned between the valve 20 and the cylindrical bore 22. As shown in FIG. 22, the O-ring 216 can be positioned with a recess 218 formed in the cylindrical bore 22. The O-ring 216 advantageously provides an additional seal to prevent leakage of chemical.

As with the previous embodiments, the illustrated embodiment 200 is also easily assembled. The two main assembling steps are (i) placing the sealing members 208, 211, 216 into the recesses 210, 213, 214 on the inner core 22 and (ii) snap-fitting the valve 20 into the valve chamber 22.

In the illustrated embodiment, the valve also defines a vent chamber 220 (see FIG. 22). In the chemical position, the vent chamber 220 is in communication with the vent passage 46, which in the illustrated embodiment extends through the sealing member 211. The vent chamber 220, in turn, is in communication with an atmospheric pressure source through an opening 222 formed in a wall of the valve 20. Advantageously, the venting chamber 220 is also in communication with the second passage 104 through an opening 226 formed in the valve 20 between the second passage and the vent chamber 222. For certain chemicals (e.g., cleaning agents), this arrangement may lead to increased foaming in the product.

FIGS. 23–31 illustrate another exemplary embodiment of a sprayer head assembly 300, wherein components that are similar to components of the assembly 10 illustrated in FIGS. 1–12 are given the same reference numbers.

Figure 23:
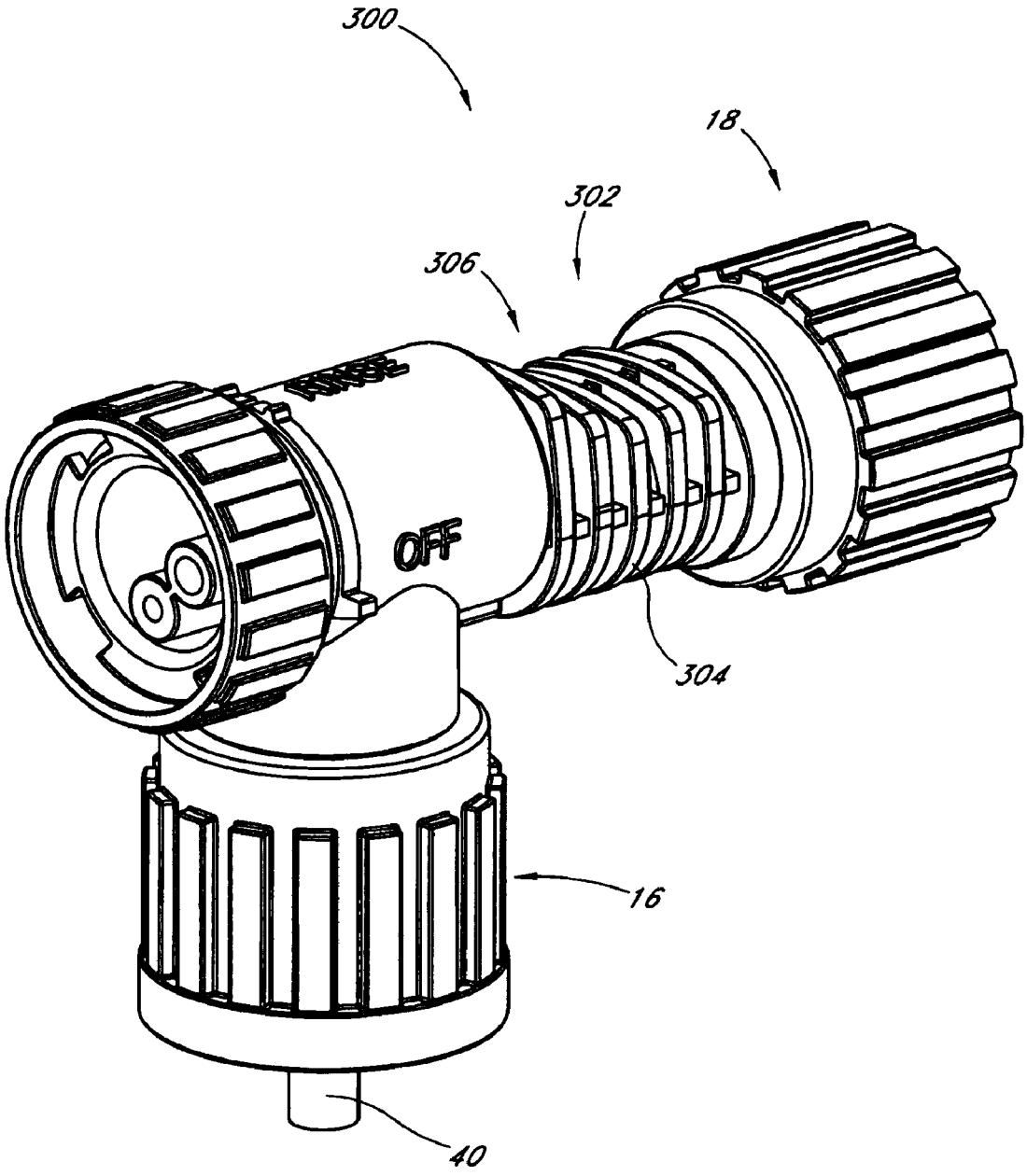
FIG. 23 is a side perspective view of another embodiment of a sprayer head assembly.
Figure 24:
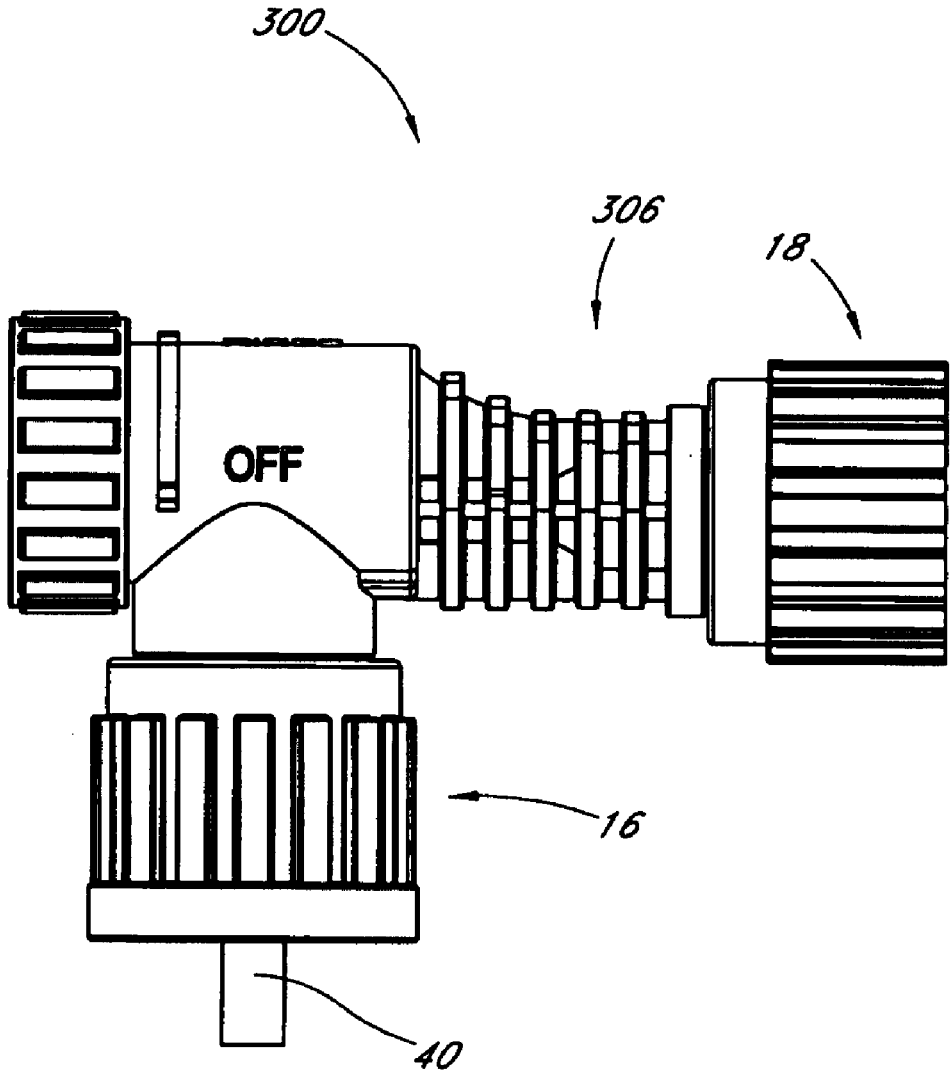
FIG. 24 is a side view of the sprayer head assembly of FIG. 23.
Figure 27:
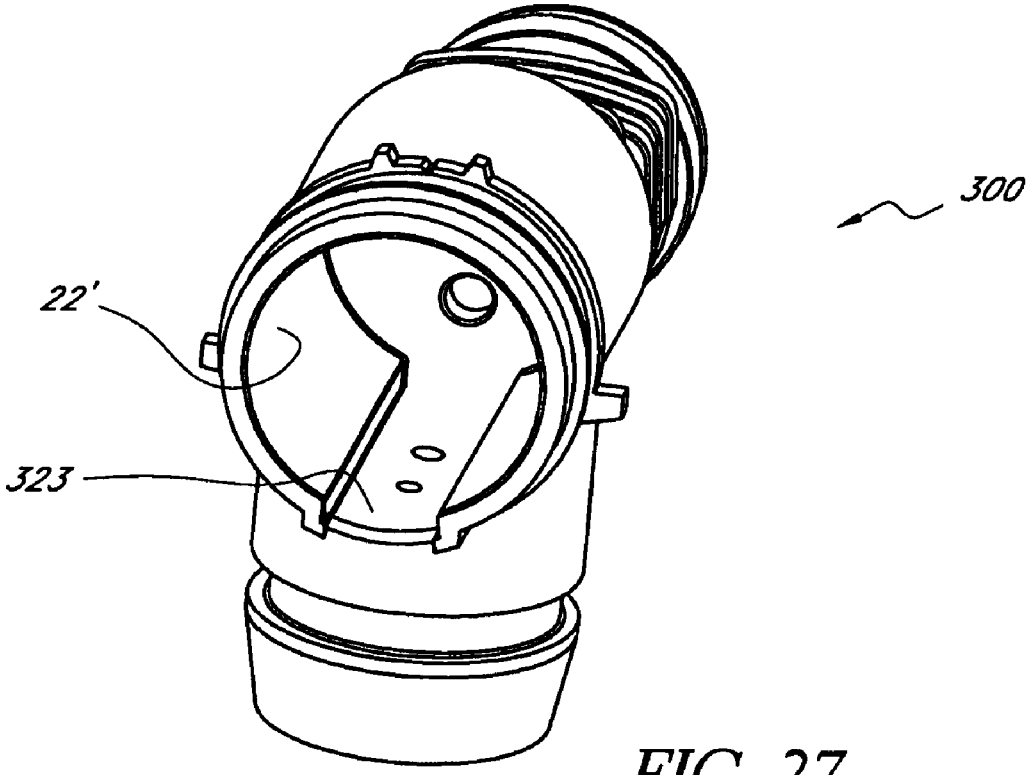
FIG. 27 is a front perspective view of an the sprayer head assembly of FIG. 23 with the valve removed.

In this embodiment, the assembly 300 includes a carrier fluid section 302, which includes reinforcing rings 304 (see FIGS. 23 and 24). A flat upper side portion portion 306 of the carrier fluid section 302 provides an ergonomic grip for the hand of a user. That is, in one arrangement, the user holds the assembly 300 by gripping the carrier fluid section such that the index and middle fingers wrap around and under the carrier fluid section 302 and the flat upperside portion 306 provides the carrier fluid section 302 with a space for the user's thumb to rest.

Figure 30:
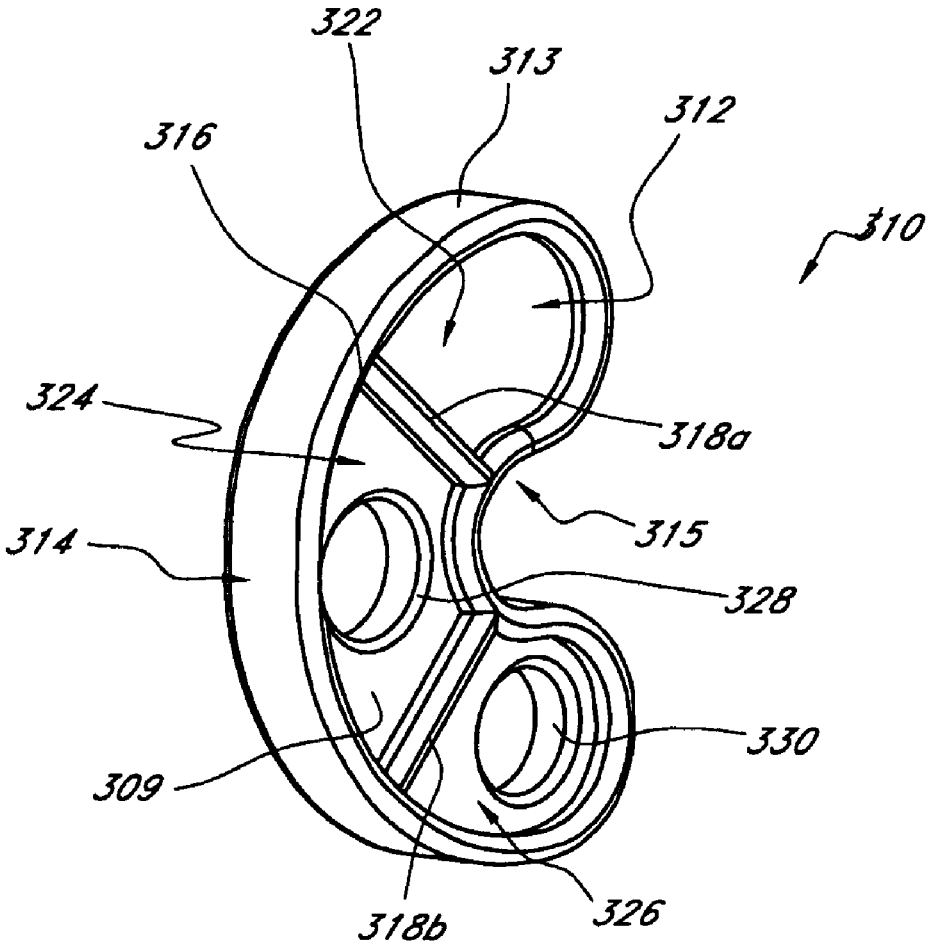
FIG. 30 is a side perspective view of an embodiment of a sealing member of the sprayer head assembly of FIG. 23.
Figure 31:
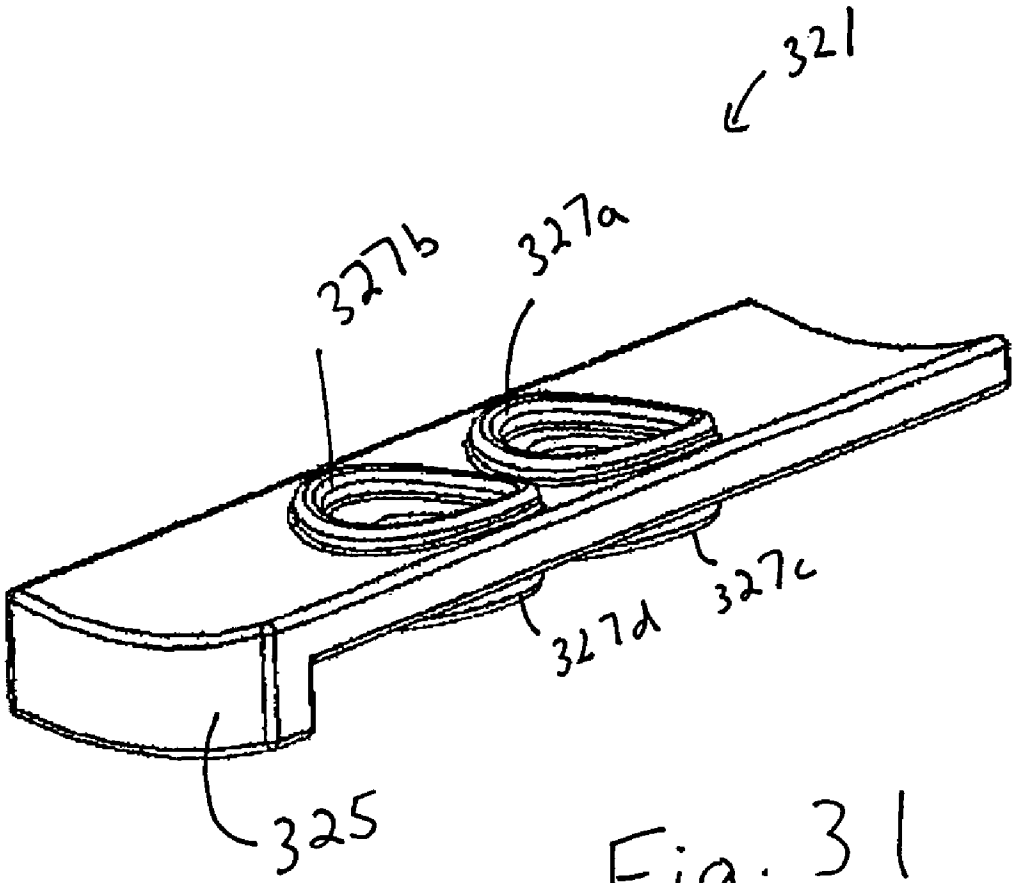
FIG. 31 is a side perspective view of an embodiment of another sealing member of the sprayer head assembly of FIG. 23.

With particular reference to FIG. 26, in the illustrated arrangement, the carrier fluid sealing portion 92 is formed by a sealing member 310, which is also shown in FIG. 30. The sealing member 310 is formed from a body 309 having a first side 311 that faces the valve 20', a second side 312 that faces the bore 22', and a side wall 313. As seen in FIG. 30, the side wall 313 has a first side portion 314 that is generally arc shaped and a second side portion 315 that is generally scalloped shaped. As such, the sealing member 310 of the exemplary embodiment has a "kidney" shape. With continued reference to FIG. 30, the side wall 313 forms a raised ridge 316, which extends around the periphery of the second side 312. In a similar manner, the side wall 313 also forms a raised ridge 317 (see FIG. 26) that extends around the periphery of the first side 311. On the second side 312, a pair of raised ridges 318*a*, 318*b* (see FIG. 3) extend between the raised ridge 316 on the first side portion 314 to the second side portion 315. In a similar manner, the first side 311 also includes a pair of raised ridges 320*a*, 320*b* (see FIG. 26) that extend between the raised ridge 317 on the first side portion 314 to the second side portion 315.

In combination, the raised ridges 316, 317, 318*a*–320*b* divided the sealing member into a first sealing portion 322, a second sealing portion 324, and a third sealing portion 326. See FIG. 30. A first opening 328 is provided in the second sealing portion 324 and a second opening 330 is provided in the third sealing portion 326.

The sealing member 310 is positioned within a recess 330 (see e.g., FIGS. 28 and 29) in the valve 20' such that the ridges 316, 318*a*, 318*b* on the second side 312 generally contact the inner bore 22' to form a seal. In a similar manner, the ridges 317, 320*a*, 320*b* on the second side 311 form a seal with the recess 330 of the valve 20. It should be appreciated that in modified embodiments the sealing member 310 may be formed without ridges on the first side 311 and/or the second side 312 such that the body 311 of the sealing member 310 contacts the valve 20' and/or inner bore 22' directly. In addition, in modified embodiments, the sealing member may be formed from two or more parts positioned in one or more recesses.

When valve 20' in the off position the first sealing portion 322 blocks the carrier passage 56 and the ridges 316, 318*a* prevent carrier fluid from leaking into the bore 22. In the carrier fluid only or "rinse" position, the first opening 328 is aligned with the carrier fluid passage 56 to permit the flow of carrier fluid through the second passage 104 and the ridges 318*a*, 318*b* prevent leakage of carrier fluid into the inner bore 22'. In the chemical or "clean" position, the second opening 330 is aligned with the carrier fluid passage 56 to permit the flow of carrier fluid into the first passage 88 while the ridges 318*b*, 316 prevent leakage around the valve 20'.

With reference to FIGS. 25, 26, 28 and 31, in this embodiment, the chemical sealing portion 98 and the vent sealing portion 102 are formed by a single sealing member 321, which is placed within a recess 323 (see FIG. 27) formed on the cylindrical bore 22'. As with the sealing member 310 described above, the sealing member 321 may be provided with one or more annular ridges 327*a*, 327*b*, 327*c*, 327*d* to provide seals between the valve 20' and/or the inner bore 22' and around the chemical and vent passages 38, 56. In the illustrated arrangement the sealing member 321 also includes an annular lip 325, which extends downwardly beyond the inner bore 22.

As with the previous embodiment, the illustrated valve 20' also includes an outer flange 340 (see FIG. 26), which is configured to snap over an annular ridge 342 formed on the outer surface of the sprayer head 14. Accordingly, the valve 20' maybe be inserted into the sprayer head 14 by snap-fitting the flange 340 over the annular ridge 342. Once snap-fitted, the valve 20' can rotate within the cylindrical bore 22' but is secured axially by the engagement of the annular ridge 342 with the annular flange 340. In modified embodiments, the flange 340 may include a groove for receiving the ridge 342. In other embodiments, the flange 340 may include a ridge configured to receive within a groove provided on the sprayer head 14.

As with the previous embodiments, the illustrated embodiment 300 is also easily assembled. The two main assembling steps are (i) placing the sealing member 310 into the recess 330 on the valve 20 (ii) placing the sealing member 321 into recess 323, and (iii) snap-fitting the valve 20' into the valve chamber 22'.

Figure 28:
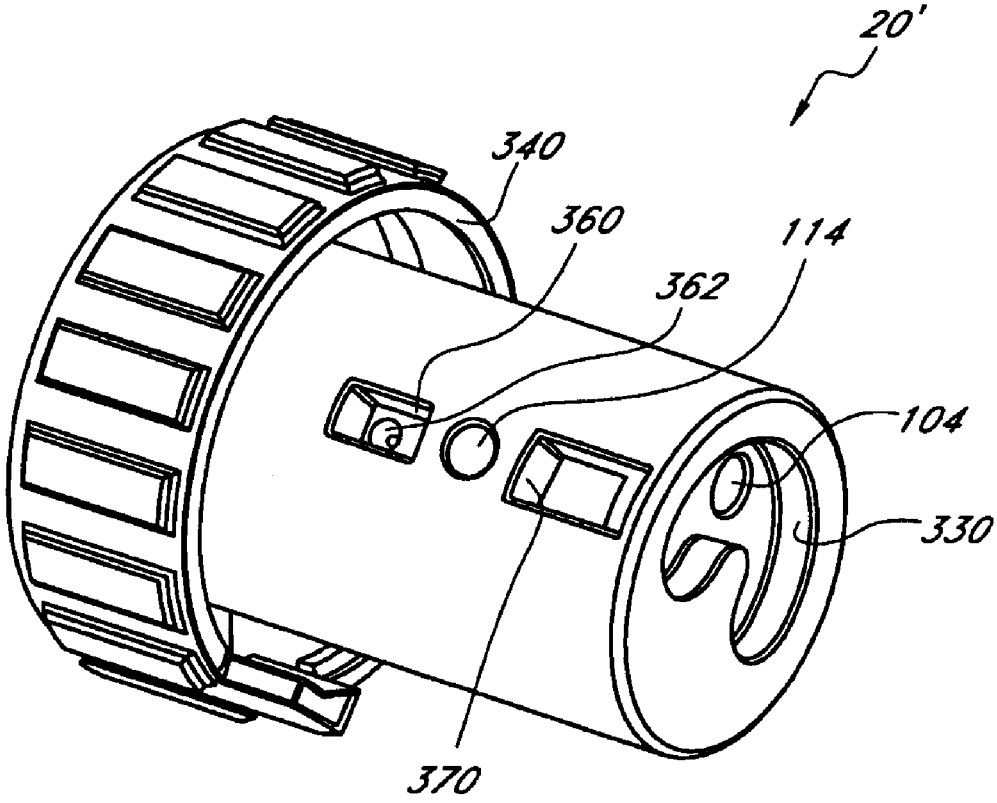
FIG. 28 is a bottom perspective view of an embodiment of a valve of the sprayer head assembly of FIG. 23.
Figure 29:
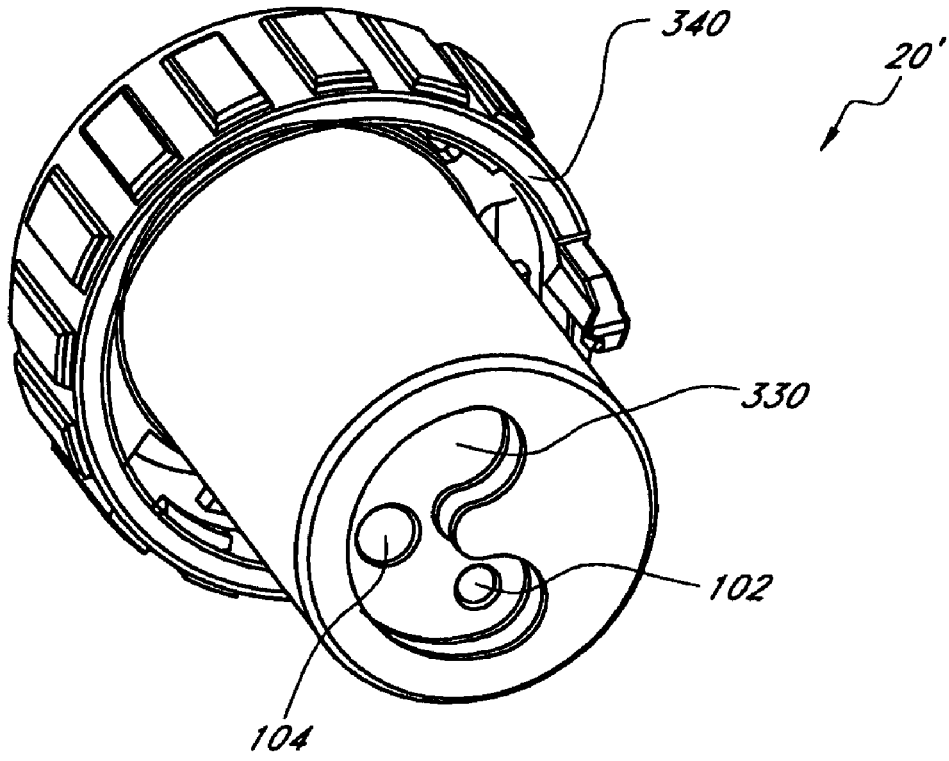
FIG. 29 is a rear perspective view of the valve of FIG. 28.

As with the previous embodiment, the valve 20' also defines a vent chamber 360 (see FIGS. 26 and 28). In the chemical position, the vent chamber 360 is in communication with the vent passage 46, which in the illustrated embodiment extends through the sealing member 321. The vent chamber 360, in turn, is in communication with the second passage 102 through an opening 362, which may provide for improved foaming of certain chemicals as described above. To place the vent passage 46 in communication with an atmospheric source, the vent chamber 360 is preferably sized configured such that when the valve 20 is in the chemical and carrier fluid position, the vent chamber 360 extends along the periphery of the valve 20 beyond the periphery of the ridge 327*b* of the sealing member 321. That is, the vent chamber 360 has a length in the direction X of FIG. 26 such that it extends beyond the ridge 327*b* of the sealing member 321. In this manner, the vent chamber 360 is in communication with atmospheric pressure through the gaps between the valve 20' and the sealing member 321. In the closed and carrier fluid only positions, the vent chamber 360 is rotated out of alignment with the vent passage 46 and is thus the vent passage 46 is no longer in communication with an atmospheric pressure source. In these positions, the valve 20' blocks the vent passage 46 and the ridge 327*b* of the sealing member 321 seals the interface between the vent passage 46 and the valve 20'.

As seen in FIG. 28, one or more cutouts 370 may be provided on the valve 20' to reduce the amount of material required to form the valve 20'.

Although this invention has been disclosed in the context of certain preferred embodiments and examples, it will be understood by those skilled in the art that the present invention extends beyond the specifically disclosed embodiments to other alternative embodiments, combinations, subcombinations and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A sprayer head assembly for connection to a container that defines a cavity for storing a chemical to be sprayed; the sprayer head assembly comprising:

a chemical passage configured to be in communication with the cavity;

a carrier fluid passage configured to be in communication with a carrier fluid source;

a housing that has an outer surface and an inner surface, which defines a valve chamber configured to be in communication with the chemical and carrier fluid passages;

a valve moveably positioned within the valve chamber between at least a first position, a second position and a third position, the valve defining a first passage, a second passage and a chemical inlet passage that is in communication with the second passage, the valve being configured such that, in the first position, the valve blocks the chemical and carrier fluid passages, in the second position, the first passage is configured to be in communication with the carrier fluid passage while the valve blocks the chemical passage, and in the third position, the second passage is configured to be in communication with the carrier fluid passage and the chemical inlet passage is configured to be in communication with the chemical passage; and a single sealing member positioned within a recess on the inner surface, the sealing member defining a sealing portion which extends around a first interface between the carrier fluid passage and the valve and a second interface between the chemical passage and the valve.

2. The sprayer head assembly as in claim 1, wherein the housing includes a retention structure which is configured to engage a corresponding retention structure on the valve in a snap fit.

3. The sprayer head assembly as in claim 2, wherein the retention structure comprises an annular ridge on the inner surface and the corresponding retention structure comprises an annular recess on the valve.

4. The sprayer head assembly as in claim 2, wherein the retention structure is positioned on the outer surface of the housing and the corresponding retention structure is positioned on an outer flange of the valve which extends over a portion of the outer surface.

5. The sprayer head assembly as in claim 4, wherein the retention structure comprises an annular ridge the outer surface of the housing and the corresponding retention structure comprises an annular ridge on the outer flange.

6. The sprayer head assembly as in claim 1, wherein the valve rotates about a first axis that is substantially parallel to the carrier fluid passage.

7. The sprayer head assembly as in claim 6, wherein the chemical passage is substantially perpendicular to the carrier fluid passage.

8. The sprayer head assembly as in claim 1, further comprising a vent passage that is communication with the valve chamber and the cavity.

9. The sprayer head assembly as in claim 8, wherein the valve defines a fourth passage which, when the valve is in the third position, is in communication with the vent passage.

10. The sprayer head assembly as in claim 9, wherein the sealing portion of the sealing member also extends around a third interface between the vent passage and the valve.

11. The sprayer head assembly as in claim 1, further comprising a screw which extends through the valve to couple the valve to the housing.

12. A sprayer head assembly for connection to a container that defines a cavity for storing a chemical to be sprayed; the sprayer head assembly comprising:

chemical passage configured to be in communication with the cavity;

a carrier fluid passage configured to be in communication with a carrier fluid source;

a housing that has an outer surface and an inner surface, which defines a valve chamber configured to be in communication with the chemical and carrier fluid passages;

a vent passage is communication with the valve chamber and the cavity; and a valve moveably positioned within the valve chamber between at least a first position, a second position and a third position, the valve defining a first passage, a second passage, a chemical inlet passage that is in communication with the second passage, and a fourth passage, the valve being configured such that, in the first position, the valve blocks the chemical and carrier fluid passages, in the second position, the first passage is configured to be in communication with the carrier fluid passage while the valve blocks the chemical passage, and in the third position, the second passage is configured to be in communication with the carrier fluid passage, the chemical inlet passage is configured to be in communication with the chemical passage and the fourth passage is in communication with the vent passage; and a single sealing member positioned within a recess on the inner surface, the sealing member defining a sealing portion which extends around a first interface between the chemical fluid passage and the valve and a second interface between the vent passage and the valve.

13. The sprayer head assembly as in claim 12, wherein the housing includes a retention structure which is configured to engage a corresponding retention structure on the valve in a snap fit.

14. The sprayer head assembly as in claim 13, wherein the retention structure is positioned on the outer surface of the housing and the corresponding retention structure is positioned on an outer flange of the valve which extends over a portion of the outer surface.

15. The sprayer head assembly as in claim 14, wherein the retention structure comprises an annular ridge the outer surface of the housing and the corresponding retention structure comprises an annular ridge on the outer flange.

16. The sprayer head assembly as in claim 12, wherein the valve rotates about a first axis that is substantially parallel to the carrier fluid passage.

17. The sprayer head assembly as in claim 16, wherein the chemical passage is substantially perpendicular to the carrier fluid passage.

18. The sprayer head assembly as in claim 12, further comprising a second sealing member positioned within a second recess on the inner surface, the second sealing member defining a sealing portion which extends around a third interface between the carrier fluid passage and the valve.

19. The sprayer head assembly as in claim 18, wherein the second sealing member is an O-ring.

20. The sprayer head assembly as in claim 12, further comprising a second sealing member positioned at a distal end of the valve chamber between the valve and the housing.

21. The sprayer head assembly as in claim 20, wherein the second sealing member comprises an O-ring positioned within a recess formed on the inner surface of the housing.

22. A sprayer head assembly for connection to a container that defines a cavity for storing a chemical to be sprayed; the sprayer head assembly comprising:

a chemical passage configured to be in communication with the cavity, said chemical passage having an outlet defining a chemical outlet axis;

a carrier fluid passage configured to be in communication with a carrier fluid source, said carrier fluid passage having an outlet defining a carrier fluid outlet axis;

a housing comprising an outer surface and an inner surface that defines a valve chamber configured to be in communication with the chemical and carrier fluid passages; and a valve moveably positioned within the valve chamber between at least a first position, a second position and a third position, the valve defining a first passage, a second passage and a chemical inlet passage that is in communication with the second passage, the valve being configured such that, in the first position, the valve blocks the chemical and carrier fluid passages, in the second position, the first passage is configured to be in communication with the carrier fluid passage while the valve blocks the chemical passage, and in the third position, the second passage is configured to be in communication with the carrier fluid passage and the chemical inlet passage is configured to be in communication with the chemical passage, the valve further configured to rotate about a first axis that is substantially parallel to the carrier fluid outlet axis and substantially perpendicular to the chemical outlet axis;

wherein the housing includes a retention structure which is configured to engage a corresponding retention structure on the valve in a snap fit.

23. The sprayer head assembly as in claim 22, wherein the retention structure comprises an annular ridge on the inner surface and the corresponding retention structure comprises an annular recess on the valve.

24. The sprayer head assembly as in claim 22, wherein the retention structure is positioned on the outer surface of the housing and the corresponding retention structure is positioned on an outer flange of the valve which extends over a portion of the outer surface.

25. The sprayer head assembly as in claim 24, wherein the retention structure comprises an annular ridge the outer surface of the housing and the corresponding retention structure comprises an annular ridge on the outer flange.

26. The sprayer head assembly as in claim 22, wherein the valve chamber further comprising at least one recess in which at least one sealing member is positioned, the at least one sealing member defining a sealing portion which extends around a first interface between the carrier fluid passage and the valve and a second interface between the chemical passage and the valve.

27. The sprayer head assembly as in claim 26, further comprising a vent passage that is communication with the cavity.

28. The sprayer head assembly as in claim 27, wherein the valve defines a fourth passage which, when the valve is in the third position, is in communication with the vent passage.

29. The sprayer head assembly as in claim 28, wherein the at least one sealing member also extends around a third interface between the vent passage and the valve.

30. A method for assembling a sprayer head assembly comprising, providing a housing defining a valve chamber that is in communication with a chemical passage and a carrier fluid passage, the valve chamber defining at least one recess; providing a valve configured to fit within the valve chamber and having at least a first passage, a second passage and a chemical inlet passage that is in communication with the second passage, placing a sealing member into the recess;

inserting the valve into the valve chamber; and coupling the valve to the housing in a snap fit.

31. The method as in claim 30, wherein inserting the valve comprises moving the valve along a longitudinal axis of the sprayer head assembly.

32. A sprayer head assembly for connection to a container that defines a cavity for storing a chemical to be sprayed; the sprayer head assembly comprising:

a chemical passage configured to be in communication with the cavity;

a carrier fluid passage configured to be in communication with a carrier fluid source;

a valve chamber configured to be in communication with the chemical and carrier fluid passages; and a valve moveably positioned within the valve chamber between at least a first position, a second position and a third position, the valve defining a first passage, a second passage and a chemical inlet passage that is in communication with the second passage, the valve being configured such that, in the first position, the valve blocks the chemical and carrier fluid passages, in the second position, the first passage is configured to be in communication with the carrier fluid passage while the valve blocks the chemical passage, and in the third position, the second passage is configured to be in communication with the carrier fluid passage and the chemical inlet passage is configured to be in communication with the chemical passage, wherein the valve rotates about a longitudinal axis and is nested within the valve chamber such that the valve is prevented from moving radially with respect to the longitudinal axis by the valve chamber;

wherein the valve chamber includes an annular ridge and the valve includes an annular recess configured to engage the annular ridge in a snap fit.

33. The sprayer head assembly as in claim 32, comprising a vent passage in communication with the valve chamber, said valve including a vent opening configured such that in the third position the vent opening is in communication with the vent passage.

34. The sprayer head assembly as in claim 32, wherein the valve includes an annular gripping surface positioned on an exterior surface of the valve, said gripping surface extending around the longitudinal axis.

* * * * *